US011708672B2

(12) United States Patent
Hoffman

(10) Patent No.: US 11,708,672 B2
(45) **Date of Patent: *Jul. 25, 2023**

(54) V-SHAPED SNOWPLOW BLADE WITH TRIP EDGE AND PIVOTABLE SNOW SHIELD

(71) Applicant: Venture Products, Inc., Orrville, OH (US)

(72) Inventor: Michael S. Hoffman, Greenwich, OH (US)

(73) Assignee: VENTURE PRODUCTS, INC., Orville, OH (US)

( * ) Notice: Subject to any disclaimer, the term of this patent is extended or adjusted under 35 U.S.C. 154(b) by 419 days.

This patent is subject to a terminal disclaimer.

(21) Appl. No.: 17/012,540

(22) Filed: Sep. 4, 2020

(65) Prior Publication Data

US 2022/0074155 A1 Mar. 10, 2022

(51) Int. Cl.
*E01H 5/06* (2006.01)

(52) U.S. Cl.
CPC ..... *E01H 5/067* (2013.01); *E01H 5/062* (2013.01); *E01H 5/063* (2013.01); *E01H 5/065* (2013.01)

(58) Field of Classification Search
CPC ..... E01H 5/067; E01H 5/062; E01H 5/063; E01H 5/065; E01H 5/066
See application file for complete search history.

(56) References Cited

U.S. PATENT DOCUMENTS 3,650,054 A 3/1972 Hanson
3,772,803 A 11/1973 Cote
3,998,342 A 12/1976 Myers
4,074,448 A 2/1978 Niemela
4,597,202 A 7/1986 Weeks
4,907,358 A * 3/1990 Moore ..... E01H 5/065 37/231
5,025,577 A 6/1991 Verseef
5,109,618 A 5/1992 Grubler et al.
5,437,113 A 8/1995 Jones
6,125,559 A 10/2000 Mullenhour
7,437,839 B2 10/2008 Christy et al.
7,743,536 B2 6/2010 Evans et al.
9,051,700 B2 6/2015 Summers et al.
9,611,604 B2 * 4/2017 Vigneault ..... E01H 5/063
(Continued)

FOREIGN PATENT DOCUMENTS

WO 2020087179 A1 5/2020

*Primary Examiner* — Jamie L McGowan
(74) *Attorney, Agent, or Firm* — Sand, Sebolt & Wernow Co., LPA

(57) ABSTRACT

A multi-position snowplow blade, a snowplow incorporating the blade and a method of use thereof. The blade includes left and right wings that each having a trip edge pivotally engaged therewith. Each trip edge includes a lower section of a moldboard, a cutting edge, and a snow shield. A biasing assembly biases the trip edge into alignment with an upper section of the moldboard. The trip edges trip when the blade strikes an obstacle on a surface being plowed. When the trip edge trips, it pivots about a horizontal axis and relative to the associated upper section. Each snow shield pivotally engages the lower section of the associated trip edge and pivots relative thereto when the trip edge trips. The pivotal motion of the two snow shields widens a gap therebetween and helps to reduce the possibility of damage to the pivoting trip edges.

19 Claims, 14 Drawing Sheets

(56) References Cited

U.S. PATENT DOCUMENTS

| | | | | |
|---|---|---|---|---|
| 10,865,534 | B2 | 12/2020 | Martin et al. | |
| 2006/0000122 | A1 | 1/2006 | Micozzi | |
| 2006/0042128 | A1* | 3/2006 | Schultz | E01H 5/062 37/232 |
| 2007/0271828 | A1 | 11/2007 | Mishra et al. | |
| 2009/0282706 | A1* | 11/2009 | Barker | E01H 5/061 37/196 |
| 2013/0232827 | A1* | 9/2013 | Summers | E01H 5/062 37/274 |
| 2014/0237865 | A1* | 8/2014 | Jones | E01H 5/066 16/374 |
| 2016/0076285 | A1 | 3/2016 | Jones et al. | |
| 2018/0127935 | A1* | 5/2018 | Paonessa | E01H 5/065 |
| 2019/0017237 | A1* | 1/2019 | Michel | E01H 5/062 |
| 2019/0136473 | A1* | 5/2019 | Desrochers | E01H 5/066 |
| 2019/0136474 | A1 | 5/2019 | Martin et al. | |
| 2019/0203436 | A1* | 7/2019 | Martin | E01H 5/066 |
| 2019/0234034 | A1* | 8/2019 | Kovalick | E01H 5/061 |
| 2019/0323204 | A1* | 10/2019 | Vigneault | E01H 1/105 |
| 2022/0243411 | A1* | 8/2022 | Vigneault | E01H 5/062 |

* cited by examiner

V-SHAPED SNOWPLOW BLADE WITH TRIP EDGE AND PIVOTABLE SNOW SHIELD

TECHNICAL FIELD

This disclosure is directed to equipment for snow removal. In particular the disclosure relates to a snowplow blade. Specifically, the disclosure is directed to a V-shaped snowplow blade with a left wing and a right wing that each have a trip edge thereon. The trip edge comprises a part of the moldboard of the blade along with a cutting edge (or wear board) that is secured thereto. When the blade strikes an obstacle on a surface while clearing snow therefrom, one or both trip edges will pivot about an associated horizontal axis and relative to an upper section of the moldboard. When both trip edges trip and pivot and begin to contact each other, the snow shield at the innermost side of the trip edge will pivot about a vertical axis and momentarily move away from the other snow shield.

BACKGROUND

Background Information

Snowplows are used to remove accumulated snow from surfaces such as roadways and sidewalks. The plows typically comprise some type of vehicle, such as a truck or utility vehicle, and a snowplow blade that is mounted to the vehicle by a hitch assembly. Snowblade blades can be straight blades, V-shaped blades that present an apex as the leading edge of the blade, and adjustable blades that can be manipulated to form a V-shape, an inverted V-shape, or be configured as a straight blade. The hitch assembly can be utilized to manipulate the blade by raising or lowering the same. In some instances, the hitch assembly can also be used to angle the snowplow blade relative to a vertical axis of the vehicle to more effectively remove snow from a surface.

Regardless of the configuration of the snowplow blade, these blades typically include a concavely-curved surface for gathering snow from a surface over which the vehicle and blade travel and redirecting the snow away from the surface. This curved surface is known as the moldboard and is typically fabricated from a material such as steel and or even stainless steel. The moldboard is therefore a relatively expensive piece of equipment. In order to preserve the integrity of the moldboard and increase the component's life, a separate cutting edge (also known as a wear board, wear blade, or scraper) is removably engaged the bottom edge of the moldboard. The cutting edge is the component of the snowplow blade that will travel along the surface of the roadway or sidewalk and scrape snow off the same, directing that snow upwardly toward the moldboard. The cutting edge may be fabricated from less-expensive materials than the moldboard. In some embodiments, the cutting edge may be fabricated from a less expensive steel or from materials such as urethane. Over time, the cutting edge will be worn down by its constant contact with the roadways or sidewalks from which the snowplow blade removes snow. If the cutting edge is worn down to too great an extent, the moldboard may start to contact the ground and become damaged. Consequently, when it is determined the cutting edge has reached this point, the cutting edge may be removed from the moldboard and be replaced with a new cutting edge.

One of the issues that occurs when clearing snow is that the roadways and sidewalks can include solid obstacles such as manhole covers, uneven sidewalk slabs, curbs, and so on.

If the snowplow is moving along the roadway or sidewalk with the snowplow blade in a lowered position removing snow from the surface, when the blade strikes the obstacle, the impact of that strike can damage the blade or the hitch assembly. The impact force can also be transferred back into the vehicle making the ride jarring and uncomfortable for the snowplow operator.

In order to aid in addressing this problem, some snowplow blades have been configured to trip when they strike solid obstacles. This "tripping" has taken two different forms in the prior art. In some instances, the entire snowplow blade (moldboard plus cutting edge) will lift vertically and/or pivot slightly about a horizontal axis as a unit when an obstacle is struck. In some instances, the horizontal axis about which the entire blade pivots is an axis located on the hitch assembly. Examples of the entire moldboard tripping include U.S. Pat. No. 4,074,408 (Niemela) and U.S. Pat. No. 4,907,340 (Moore).

In other instances, only the cutting edge of the snowplow blade will trip when an obstacle is struck by the cutting edge. In some instances the cutting edge will lift vertically to a certain degree relative to the moldboard. In other instances, the cutting edge will pivot relative to the moldboard about a horizontal axis. Examples of snowplows where only the cutting edge trips include U.S. Pat. No. 3,772,803 (Cote), U.S. Pat. No. 5,025,577 (Verseef), and U.S. Pat. No. 5,437,113 (Jones).

In some instances, the snowplow blades can include both moldboard tripping and cutting edge (i.e., wear blade) tripping. An example of this configuration is found in U.S. Pat. No. 9,051,460 (Summers et al).

V-shaped snowplow blades present a particular problem when they strike obstacles in the roadway or on the sidewalk. V-shaped snowplow blades includes a left side blade or "left wing" and a right side blade or "right wing". The left wing and right wing may be fixedly secured to one another so that the blade is permanently V-shaped. In these instances, the blades are frequently mounted that the entire moldboard (i.e., the entire blade) trips when the blade encounters an obstacle. In other instances, the central region between the left wing and right wing and below a shaft to which the wings are attached will be free of a cutting edge. A trippable cutting edge will be engaged with the left wing and another trippable cutting edge will be engaged with the right wing. The two cutting edges will be sufficiently distanced from one another so as not to strike one another when they trip. If the two cutting edges are physically too close to one another then, when they trip, they might strike one another and become damaged.

In other instances, the V-shaped blade is adjustable in configuration as indicated earlier herein. U.S. Pat. No. 9,051,460 (Summers et al) referred to earlier herein discloses a multi-position V-shaped snowplow blade that can be adjusted to various different configurations. The left wing and right wing of these adjustable V-shaped blades will connect to a central hinge and will be rotatable about a vertical axis that extends along the central hinge. The region between the bottom regions of the left wing and right wing is generally triangular in shape and a separate component, a snow catcher or snow shield, is engaged with each wing. The shield(s) close off the triangular shaped gap between the bottom regions of the left wing and right wing and will contact the surface so that as the blade travels over the surface snow is cleared from even below the central hinge. When the blade is in an inverted V-shape with the apex as the leading part of the blade, this arrangement does not present too many issues if the wear blade on only one or the other of the left wing and right wing trips. However, if the snowplow blade impacts an obstacle that causes the cutting edges or wear blades on both the left and right wings to trip substantially simultaneously, then the snow shields on the two wings may contact or interfere with one another when the cutting edges both pivot. This interference may prevent the cutting edges from tripping properly and/or can result in damage to the cutting edges or even to the moldboard.

SUMMARY

A snowplow blade, a snowplow incorporating the blade and a method of use thereof is disclosed herein. The blade includes left and right wings that each having a trip edge pivotally engaged therewith. Each trip edge includes a lower section of a moldboard, a cutting edge, and a snow shield. A biasing assembly biases the trip edge into alignment with an upper section of the moldboard. The trip edges trip when the blade strikes an obstacle on a surface being plowed. When the trip edge trips, it pivots about a horizontal axis and relative to the associated upper section. Each snow shield pivotally engages the lower section of the associated trip edge and pivots relative thereto when the trip edge trips. The pivotal motion of the two snow shields widens a gap therebetween and helps to reduce the possibility of damage to the pivoting trip edges.

The snowplow blade in one embodiment is a multi-position blade. In other embodiments, the snowplow blade is a V-shaped snowplow blade (V-blade) that has left and right wings that may be arranged in a fixed orientation relative to each other. The blade includes a moldboard and a trip edge pivotally engaged therewith. The trip edge includes a lower section of the moldboard and a cutting edge that is engaged with the lower section. A snow shield is pivotally engaged with the lower section proximate a first side thereof. The trip edges of both wings of the blade will automatically pivot about an associated horizontal axis when tripped, i.e., when one or both trip edges strike an obstacle on a surface being cleared of snow during plowing. If both the left wing and right wing strike an obstacle and trip substantially simultaneously, the disclosed configuration of the snowplow blade will substantially prevent interference between the pivoting trip edges by pivoting the snow shields of the trip edges away from each other and thereby increasing the effective distance between the pivoting trip edges. The pivoting motion of the trip edges will tend to reduce the likelihood of damage to the cutting edges, the lower sections, the snow shields, and the moldboards of the two wings. The trip edge returns to its original position under spring force when the trip event is over. Additionally, the snow shields each return to their original position under spring force when the trip event is over.

In one aspect, an exemplary embodiment of the present disclosure may provide a blade for a snowplow comprising a left wing and a right wing, wherein each of the left wing and the right wing includes a moldboard; a trip edge; and a biasing assembly that biases the trip edge into alignment with the moldboard; wherein when the trip edge is tripped by encountering an obstacle on a surface being cleared of snow by the blade, the biasing assembly enables the trip edge to pivot about a horizontal axis and relative to the moldboard; and wherein a portion of the trip edge is pivotally engaged with a rest of the trip edge and the portion of the trip edge pivots relative to the rest of the trip edge when the trip edge trips.

In one embodiment, the portion of the trip edge is a snow shield and the snow shield of the left wing may be located adjacent the snow shield of the right wing; and wherein the snow shields may be configured to pivot away from each other when the trip edges on the left wing and the right wing are substantially simultaneously tripped. In one embodiment, each trip edge comprises a first member; and a snow shield; wherein the snow shield is the portion of the trip edge that is pivotally engaged with the rest of the trip edge; and wherein the rest of the snow shield is the first member; and wherein the snow shield is configured to pivot about the axis relative to the first member between a first position and a second position. In one embodiment, the first member may have a first side; and the axis about which the snow shield pivots is oriented may be parallel to the first side of the first member. In one embodiment, the left wing and right wing may be selectively rotatable about a vertical axis; and the first side of the first member may be inclined at an angle relative to the vertical axis.

In one embodiment, the left wing and the right wing may extend outwardly from a vertical axis; and the snow shield may angle rearwardly from a first side of the first member and inwardly toward the vertical axis. In one embodiment, the blade may further comprise a spring assembly that urges the snow shield into the first position. In one embodiment, the blade may be a multi-position blade that further comprises a central hinge with which the left wing and right wing are operationally engaged and about which the left wing and the right wing may be selectively pivotable into a number of different configurations. In one embodiment, the biasing assembly may be a spring assembly. In one embodiment, the trip edge of each of the left wing and the right wing may include a cutting edge that is adapted to contact the surface from which snow is to be removed by the blade when the trip edge is in a non-tripped position. In one embodiment a bottom end of the snow shield of the trip edge of each of the left wing and the right wing may be adapted to contact the surface from which snow is to be removed when the trip edge is in a non-tripped position. In one embodiment the trip edge may further comprise a skid shoe that is operatively engaged with the trip edge, and the skid shoe may pivot in unison with the trip edge.

In another aspect, an exemplary embodiment of the present disclosure may provide a method of preventing damage to a blade of a snowplow comprising operatively engaging a left wing and a right wing of the blade of the snowplow with a central shaft; providing a trip edge on a moldboard of each of the left wing and the right wing; biasing the trip edge into alignment with the moldboard; biasing a snow shield provided on the trip edge toward the central shaft; pivoting the trip edge relative to the moldboard about a horizontal axis when the trip edge impacts an obstacle on a surface from which the blade is clearing snow and trips; and pivoting the snow shield relative to a rest of the trip edge.

In one embodiment, the pivoting of the trip edge about the horizontal axis may include breaking contact between the trip edge and the surface from which the blade is clearing snow. In one embodiment, in the pivoting of the snow shield may include pivoting the snow shield about an axis that extends parallel to a first side of a first member of the trip edge. In one embodiment, the pivoting of the snow shield may include pivoting the snow shield on the left wing in a first direction and pivoting the snow shield on the right wing in an opposite second direction; and increasing a gap defined between the snow shield on the left wing and the snow shield on the right wing. In one embodiment, the method may further comprise pivoting the trip edge in an opposite direction after the trip edge has tripped; and pivoting the trip edge in the opposite direction may include pivoting the trip edge back into alignment with the moldboard under spring force. In one embodiment, the pivoting of the snow shield may include pivoting the snow shield away from the central shaft when the trip edge trips and is pivoted out of alignment with the moldboard; and wherein the method further may include pivoting the snow shield back toward the central shaft when the trip edge moves back into alignment with the moldboard.

In another aspect, an exemplary embodiment of the present disclosure may provide a snowplow comprising a vehicle; a multi-position snowplow blade; and a hitch assembly that selectively secures the multi-position snowplow blade to the vehicle; and wherein the multi-position snowplow blade comprises a left wing and a right wing each including a moldboard; a trip edge that is selectively pivotable about a horizontal axis when tripped; and a biasing assembly that biases the trip edge into alignment with the moldboard; wherein the trip edge includes a snow shield that is pivotally engaged with a rest of the trip edge; and wherein the snow shield is pivotable relative to the rest of the trip edge when the trip edge pivots about the horizontal axis. In one embodiment, the hitch assembly may be operable to reconfigure the multi-position snowplow blade and to maneuver the multi-position snowplow blade relative to the utility vehicle.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
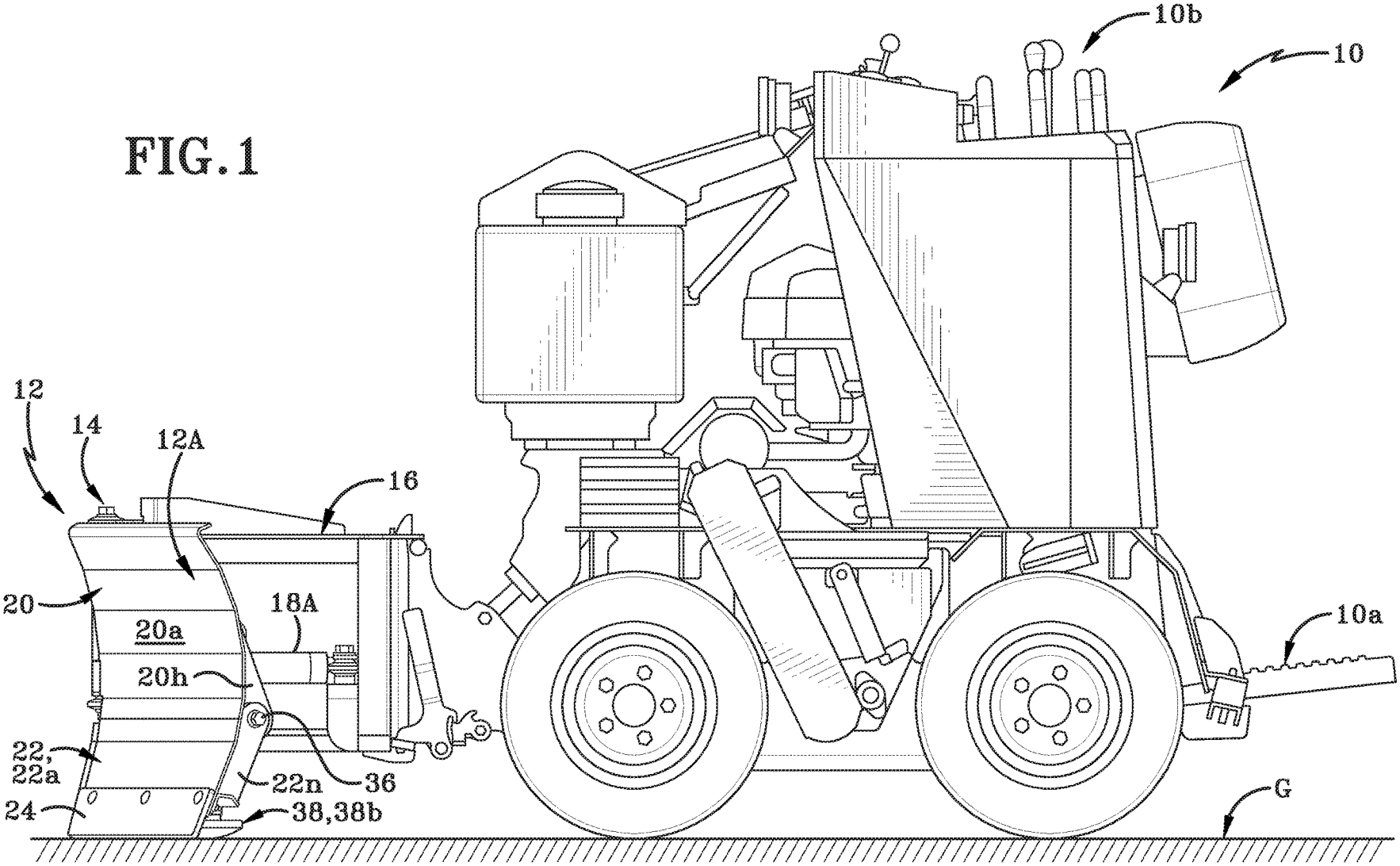
FIG. 1 is a left side elevation view of a snowplow comprising a utility vehicle upon which is mounted a V-shaped blade in accordance with the present disclosure.

FIG. 1 shows a utility vehicle 10 upon which is mounted a snowplow blade in accordance with the present disclosure, generally indicated at 12. As illustrated, the vehicle 10 includes a platform 10*a* upon which an operator will stand. Vehicle 10 also includes a control panel 10*b* that the operator uses to control the vehicle 10 and blade 12. Utility vehicle 10 is illustrated as a relatively small vehicle that may be used by a landscaping company or an individual to maintain driveways, sidewalks, and smaller surfaces that need to be cleared of snow but might require the vehicle to move in tight spaces. It will be understood that utility vehicle 10 is exemplary only and may be any vehicle that is capable of being used in winter conditions. It will be understood that if the vehicle 10 is a larger truck, the snowplow blade 12 may be fabricated to be of a size suitable for use therewith and that in such instances, the vehicle 10 and blade 12 may be utilized to clear snow from roadways, parking lots, and other larger surfaces.

Figure 2:
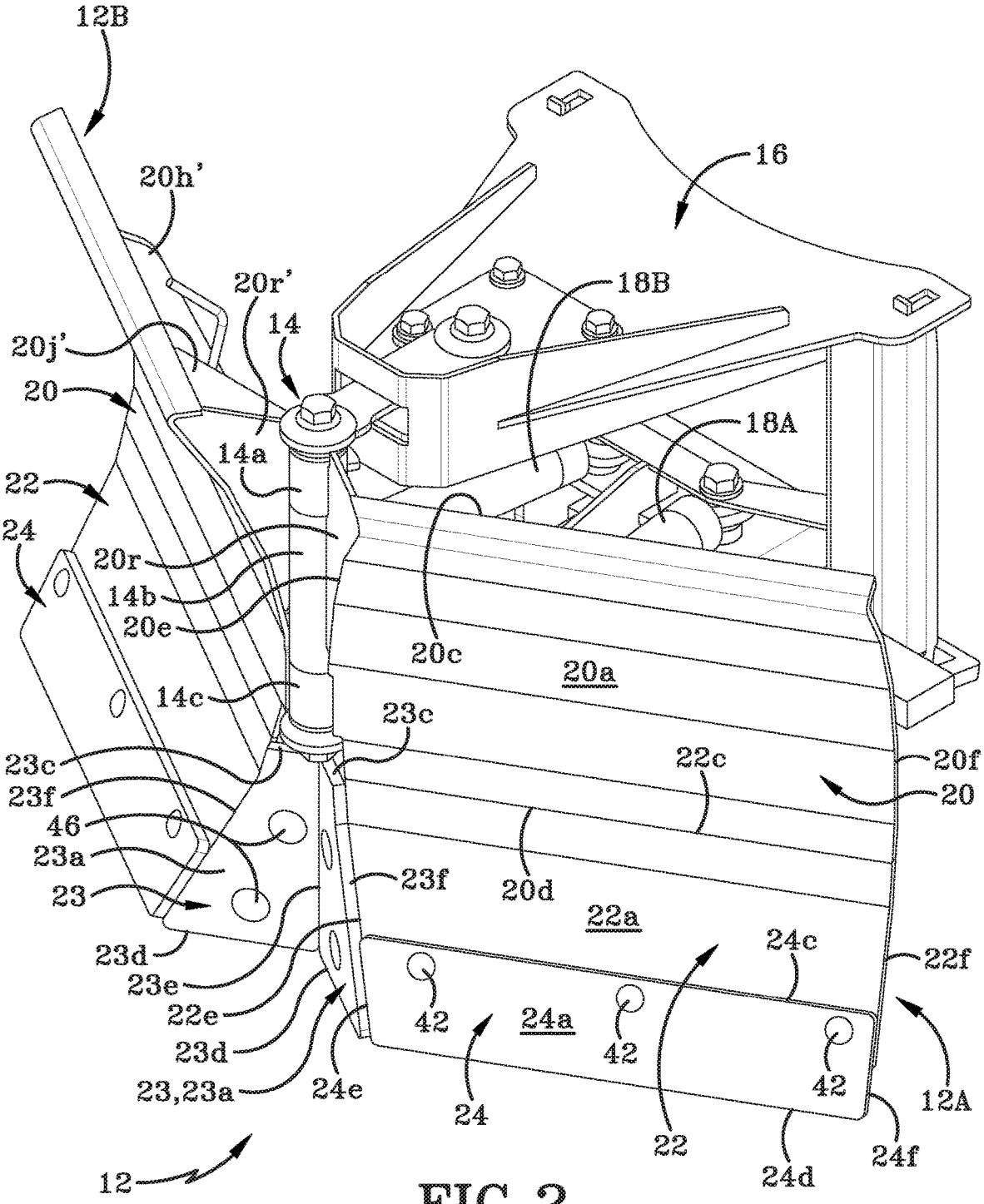
FIG. 2 is a front, top, left, isometric perspective view of the blade of FIG. 1 in accordance with the present disclosure shown on its own.

FIG. 2 shows snowplow blade 12 on its own. Blade 12 is a V-blade that, as illustrated and described herein, may be reconfigured to present different snow-clearing profiles as the conditions require. The V-blade may therefore be referred to as an adjustable snowplow blade or a multi-position snowplow blade. The adjustability of blade 12 will be discussed later herein.

Blade 12 comprises a left wing 12A and a right wing 12B that are each operably engaged with a central hinge 14. Each of the left wing 12A and right wing 12A may be individually pivoted about a vertical axis "Y" (FIGS. 3 and 4) that extends along a shaft (not shown) of central hinge 14.

A hitch assembly 16 is operably engaged with left wing 12A, right wing 12B, and central hinge 14. Hitch assembly 16 is utilized to secure blade 12 to utility vehicle 10 and is operable to raise, lower, and reconfigure blade 12. Hitch assembly 16 as illustrated is exemplary only and it should be understood that any other suitable type of hitch assembly may be utilized to secure blade 12 to utility vehicle 10 and to permit operation of blade 12. Hitch assembly 16 will therefore not be described in any detail herein. One suitable hitch assembly for operatively engaging the blade 12 to utility vehicle 10 is disclosed in a copending patent application assigned to the present Assignee, Venture Products, Inc. That copending patent application is U.S. patent application Ser. No. 16/150,873, filed Oct. 3, 2018, entitled "Unique Attachment Assembly and Method of Use". The entire disclosure of this copending application is incorporated herein by reference.

Figure 3:
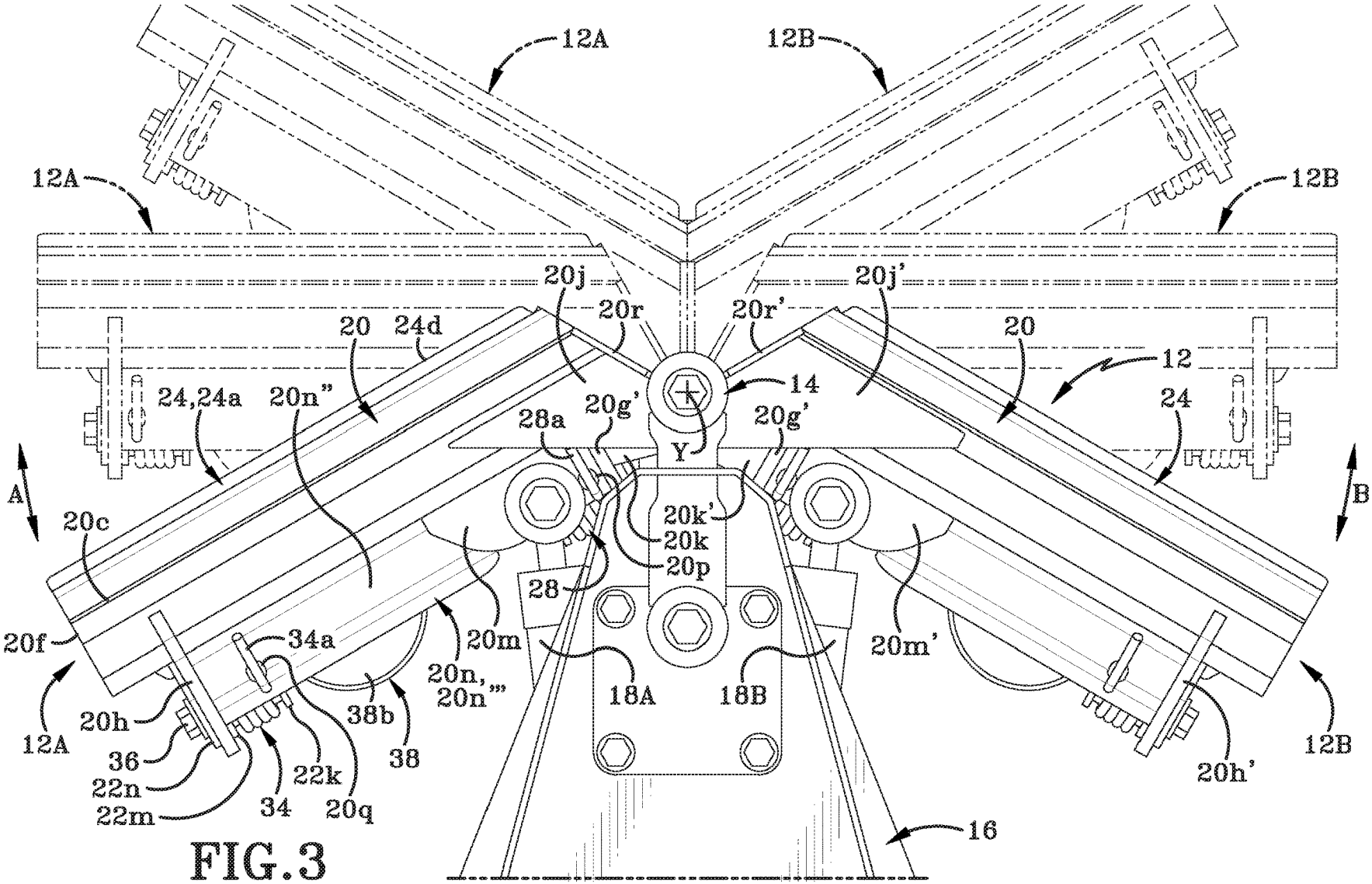
FIG. 3 is a top plan view of the blade of FIG. 2 illustrating the adjustability of the blade.

As best seen in FIG. 3, a first cylinder 18A of hitch assembly 16 operably engages left wing 12A to hitch assembly 16 and a second cylinder 18B operably engages right wing 12B to hitch assembly 16. First and second cylinders 18A, 18B may be hydraulic cylinders that are operatively linked to the hydraulic system of vehicle 10 or are engaged with a separate hydraulic system provided on vehicle 10. Alternatively, first and second cylinders 18A, 18B may be pneumatic cylinders that are operatively linked to a pneumatic system of vehicle 10 or are engaged with a separate pneumatic system provided on vehicle 10. Alternatively, first and second cylinders 18A, 18B may be electrically actuated.

First and second cylinders 18A, 18B are separately operable from vehicle 10 to pivot the associated left wing 12A and right wing 12B about the vertical axis "Y" (FIGS. 3 and 4) extending along central hinge 14. First cylinder 18A is operable to pivot left wing 12A about vertical axis "Y" as indicated by the arrows "A" in FIG. 3. Similarly, second cylinder 18B is operable to pivot right wing 12B about vertical axis "Y" as indicated by the arrows "B" in FIG. 3. By selectively pivoting left wing 12A and right wing 12B, snowplow blade 12 can be configured to be generally an inverted V-shape when viewed from above from vehicle 10 as shown in solid lines in FIG. 3. Snowplow blade 12 can also be configured so that the left wing 12A and right wing 12B are aligned in a same plane. In this instance, the blade 12 assumes the same shape as a straight snowplow blade, as is shown in phantom in FIG. 3. Left wing 12A and right wing 12B may further be reconfigured to generally assume a V-shape when viewed from above from the vehicle 10, as further shown in phantom in FIG. 3. Still further, each of the left wing 12A and right wing 12B is able to be positioned anywhere between the generally inverted V-shape and the V-shape. Consequently, the snowplow blade 12 is selectively manipulated to assume a variety of different configurations to best enable the device to remove snow from different surfaces.

Left wing 12A and right wing 12B are substantially identical in structure and function and are engaged with central hinge 14 as mirror images of one another. The following description is directly primarily to left wing 12A but it will be understood that the description applies equally to right wing 12B. Differences between the left wing 12A and right wing 12B will be pointed out.

Referring mainly to FIGS. 2 to 8 and 10A, left wing 12A of blade 12 comprises a moldboard which includes an upper section 20, a lower section 22, a shield 23 (also referred to herein as a snow shield 23), and a cutting edge 24. The cutting edge 24 may also be referred to herein as a wear board or wear blade. Shield 23 and cutting edge 24 are operatively engaged with lower section 22 of the moldboard. Lower section 22, shield 23, and cutting edge 24, together, form a trip edge that is able to pivot about a horizontal axis "X" (FIGS. 5, 6, 10A and 11A) relative to upper section 20 of moldboard. Lower section 22 may be described herein as a first member of the trip edge, snow shield 23 may be described herein as a second member of the trip edge, and cutting edge 24 may be described herein as a third member of the trip edge.

The upper section 20 and lower section 22 of the moldboard are fabricated from the same material. Suitable materials are steel or stainless steel. It is not contemplated that the lower section 22 will contact the surface "G" (FIG. 9) over which the V-blade 12 is traveling. Instead, the components of left wing 12A that will contact the surface "G" or be in close proximity thereto are cutting edge 24 and snow shield 23. Typically, the cutting edge 24 is fabricated from a different material than upper section 20 and lower section 22. In one embodiment, the cutting edge 24 is fabricated from a less expensive and less durable material than upper section 20 and lower section 22 such as urethane or a less expensive steel. Since snow shield 23 also contacts the surface "G", snow shield 23 may also tend to wear away over time through contact with surface "G". For this reason, snow shield 23 may be fabricated from the same material or a similar material to cutting edge 24. In other embodiments, the snow shield 23 may be fabricated from the same material as upper and lower sections 20, 22 of the moldboard.

As shown in FIGS. 2 to 5, upper section 20 of the moldboard is a generally concavely-curved component having a front surface 20*a*, a rear surface 20*b* (FIG. 4), a top edge 20*c*, a bottom edge 20*d* (FIG. 10A), a first side 20*e* (FIG. 5), and a second side 20*f*. A first plate 20*g* (FIG. 4), a second plate 20*h*, and a third plate 20*g* extend rearwardly from the rear surface 20*b*.

A first plate 20*g* and a second plate 20*h* are vertically oriented and extend outwardly from rear surface 20*b*, generally at right angles thereto. First plate 20*g* is located a short distance inwardly from first side 20*e* and second plate 20*h* is located a short distance inwardly from second side 20*f*. First and second plates 20*g*, 20*h* are laterally spaced a distance apart from one another and originate a distance downwardly from top edge 20*c* of upper section 20. A leading portion of each plate 20*g*, 20*h* terminates proximate bottom edge 20*d*. A trailing portion of each plate 20*g*, 20*h* extends downwardly for a distance below bottom edge 20*d* of upper section 20, as can best be seen in FIG. 11A. With this arrangement, the trailing portion of each plate 20*g*, 20*h* overlaps an upper region of the lower section 22 of the moldboard of left wing 12A but is not secured thereto.

Upper section 20 of the moldboard also includes a first plate 20*j* (FIG. 4), a second plate 20*k*, and a third plate 20*m*, which are horizontally-oriented and parallel to one another. The plates 20*j*, 20*k*, and 20*m* extend outwardly from rear surface 20*b* of upper section 20. First plate 20*j* is located a distance vertically above second plate 20*k*, which is located a distance vertically above third plate 20*m*. First plate 20*k* and second plate 20*m* extend horizontally between vertical first plate 20*g* and central hinge 14. Central hinge 14 includes a vertical shaft (not shown) around which an upper sleeve 14*a*, a middle sleeve 14*b*, and a lower sleeve 14*c* are received. (The vertical axis "Y" about which left wing 12A and right wing 12B pivot extends along this shaft of central hinge 14.) Upper sleeve 14*a* and lower sleeve 14*c* are welded to right wing 12B and middle sleeve 14*b* is welded to left wing 12A. In particular, first plate 20*j* and second plate 20*k* are welded to middle sleeve 14*b* of central hinge 14.

Third plate 20*m* extends laterally outwardly from an opposite side of first plate 20*g* from first and second plates 20*j*, 20*k*. Third plate 20*m* extends towards second plate 20*h* but terminates a distance laterally away from second plate 20*h*. First cylinder 18A connects to third plate 20*m*. FIG. 3 shows that a connector for first cylinder 18A abuts an upper surface of third plate 20*m*. It will be understood that in other embodiments this connector for first cylinder 18A abuts a lower surface of third plate 20*m*.

It should be noted that second wing 12B has two vertically oriented plates 20*g*', 20*h*'. First and second plates 20*g*, 20*h* of left wing 12A are substantially identical in structure to second 20*h*' of right wing 12B. First plates 20*g* and 20*g*' are slightly differently configured relative to one another with first plate 20*g*' being longer than first plate 20*g*. Second wing 12B includes three horizontally oriented plates 20*j*', 20*k*' and 20*m*' that are substantially parallel to each other and arranged so that first plate 20*j*' is closest to the top edge of right wing 12B. Second plate 20*k*' is located a distance vertically below first plate 20*j*' and third plate 20*m*' is located a distance vertically below second plate 20*k*'. First plate 20*j*' and second plate 20*k*' extend between the vertical first plate 20*g*' and central hinge 14. In particular, first plate 20*j*' is welded to upper sleeve 14*a* of central hinge 14 and second plate 20*k*' is welded to lower sleeve 14*c* of central hinge 14. Third plate 20*m*' is substantially identical to third plate 20*m* of left wing 12A and is substantially coplanar therewith. Third plate 20*m*' extends laterally from first plate 20*g* towards second plate 20*h* but terminates a distance away from second plate 20*h*. The second cylinder 18B engages third plate 20*m*' in much the same manner as first cylinder 18A engages third plate 20*m*. The arrangement of the engagement of left wing 12A, right wing 12B, and central hinge 14 enables left and right wings 12A, 12B to be individually pivoted about central hinge 14 and relative to one another when actuated by cylinders 18A and 18B, respectively.

It will be understood that in other embodiments the arrangement of the vertically-oriented first and second plates 20*g*, 20*h* and the horizontally-oriented first, second, and third plates 20*j*, 20*k*, 20*m* of left wing 12A may, instead, be provided on right wing 12B; and the vertically-oriented first and second plates 20*g*', 20*h*' and horizontally-oriented first, second, and third plates 20*j*', 20*k*', 20*m*' of right wing 12B may, instead, be provided on left wing 12A.

Figure 4:
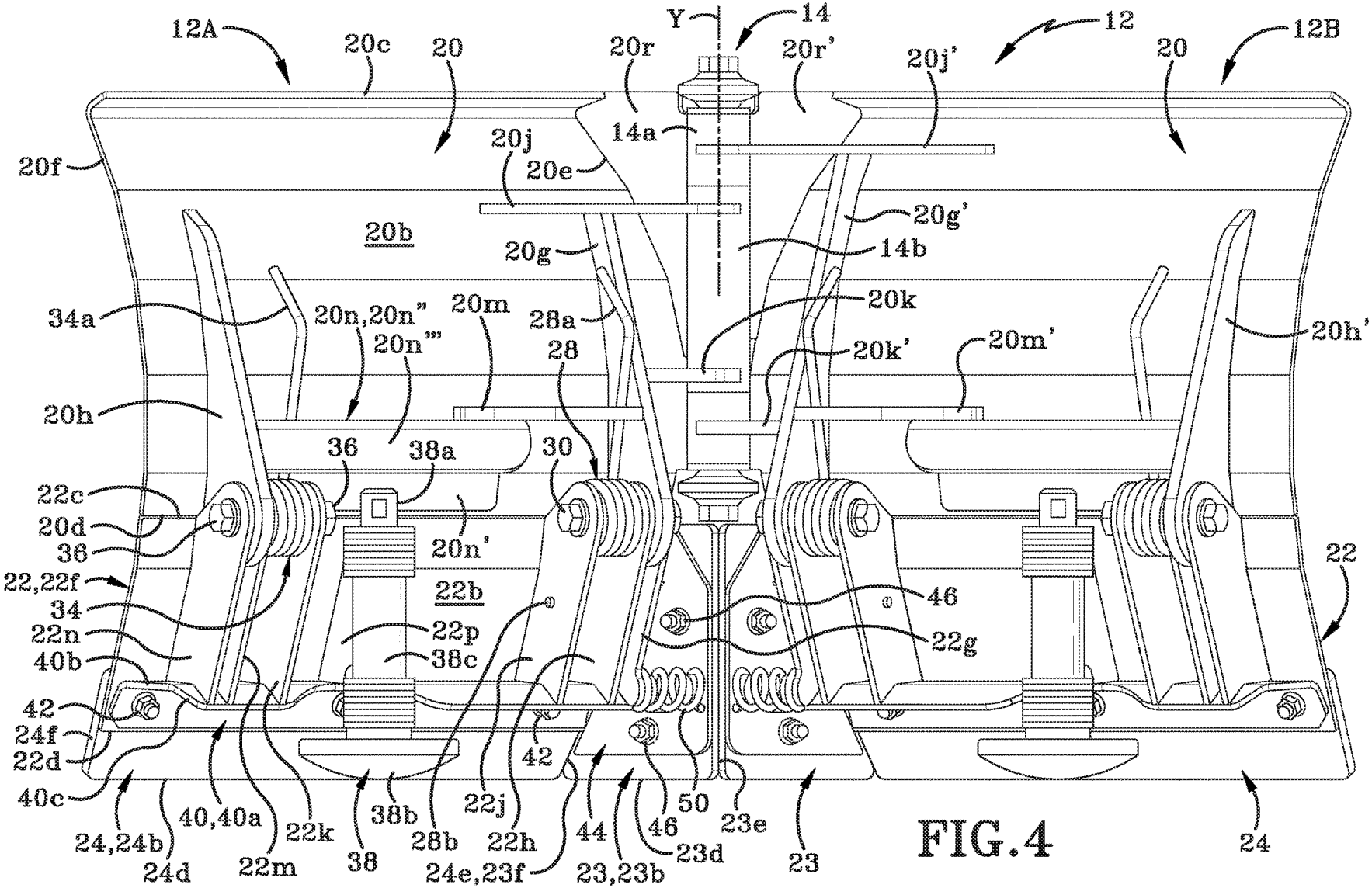
FIG. 4 is a rear elevation view of the blade with the hitch assembly omitted for clarity of illustration.
Figure 7:
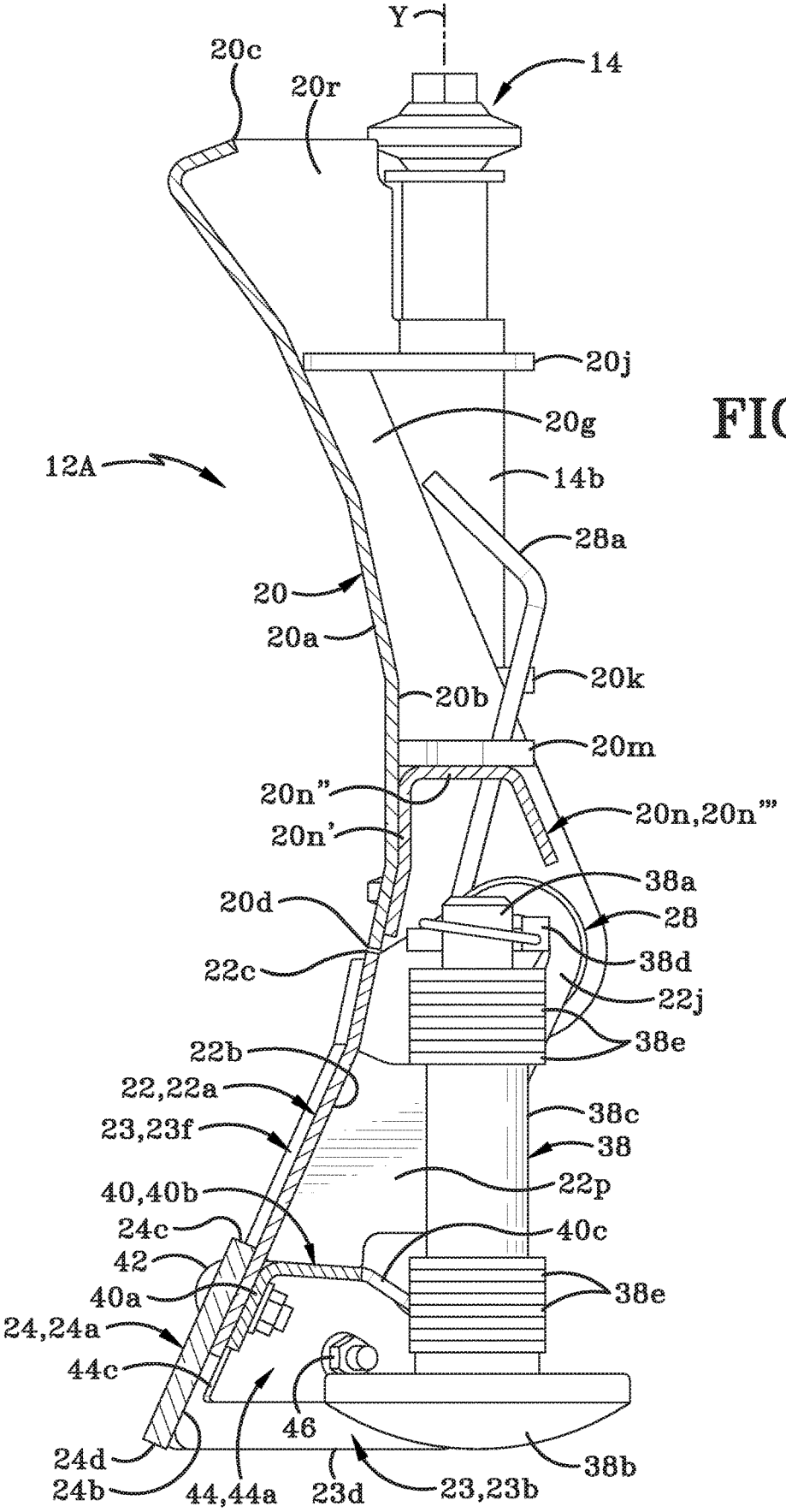
FIG. 7 is a cross-section through the left wing of the blade taken along line 7-7 of FIG. 5.
Figure 8:
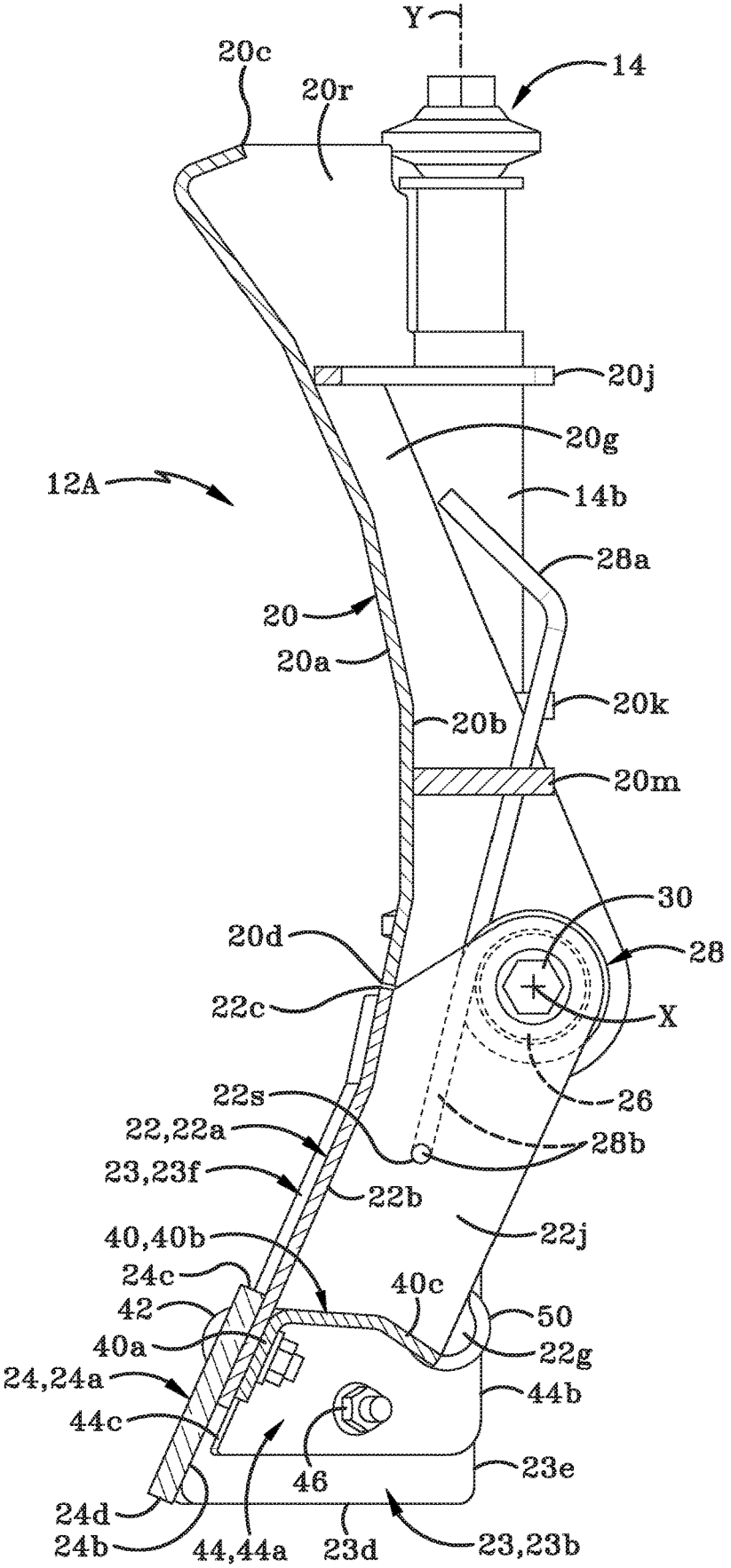
FIG. 8 is a cross-section through the left wing of the blade taken along line 8-8 of FIG. 5.

Referring to FIGS. 7 and 8, upper section 20 of the moldboard also includes a generally U-shaped plate 20*n* that comprises a first leg 20*n*', a second leg 20*n*", and a third leg 20*n*'". Plate 20*n* is welded to the inner surface of vertical second plate 20*h* and first leg 20*n*' is welded to rear surface 20*b* of upper section 20. Second leg 20*n*" is substantially horizontally oriented and parallel to first, second, and third plates 20*j*, 20*k*, 20*m*. Plate 20*n* extends laterally from vertical second plate 20*h* towards first plate 20*g* but terminates a distance therefrom. Third plate 20*m* abuts second leg 20*n*" and is located immediately above the same as can be seen in FIG. 4. Second leg 20*n*" and third plate 20*m* are welded to one another.

Referring to FIG. 3, a first aperture 20*p* is defined in third plate 20*m* and a second aperture 20*q* is defined in second leg 20*n*" of U-shaped plate 20*n*. The first and second apertures 20*p*, 20*q* extend between the upper and lower surfaces of the respective plate. The purpose of these two apertures 20*p*, 20*q* will be discussed later herein.

FIGS. 2 and 3 show that a first side plate 20*r* is welded to first side 20*e* of left wing 12A proximate top edge 20*c* thereof. Similarly, a first side plate 20*r*' is welded to first side 20*e* of right wing 12A proximate the top edge thereof. The first side plates 20*r* and 20*r*' flank central hinge 14 and are positioned forwardly of the first plates 20*j*, 20*j*'. First side plates 20*r*, 20*r*' aid in preventing snow that rides up the moldboard from becoming wedged between central hinge 14 and the left and right wings 12A, 12B.

Figure 5:
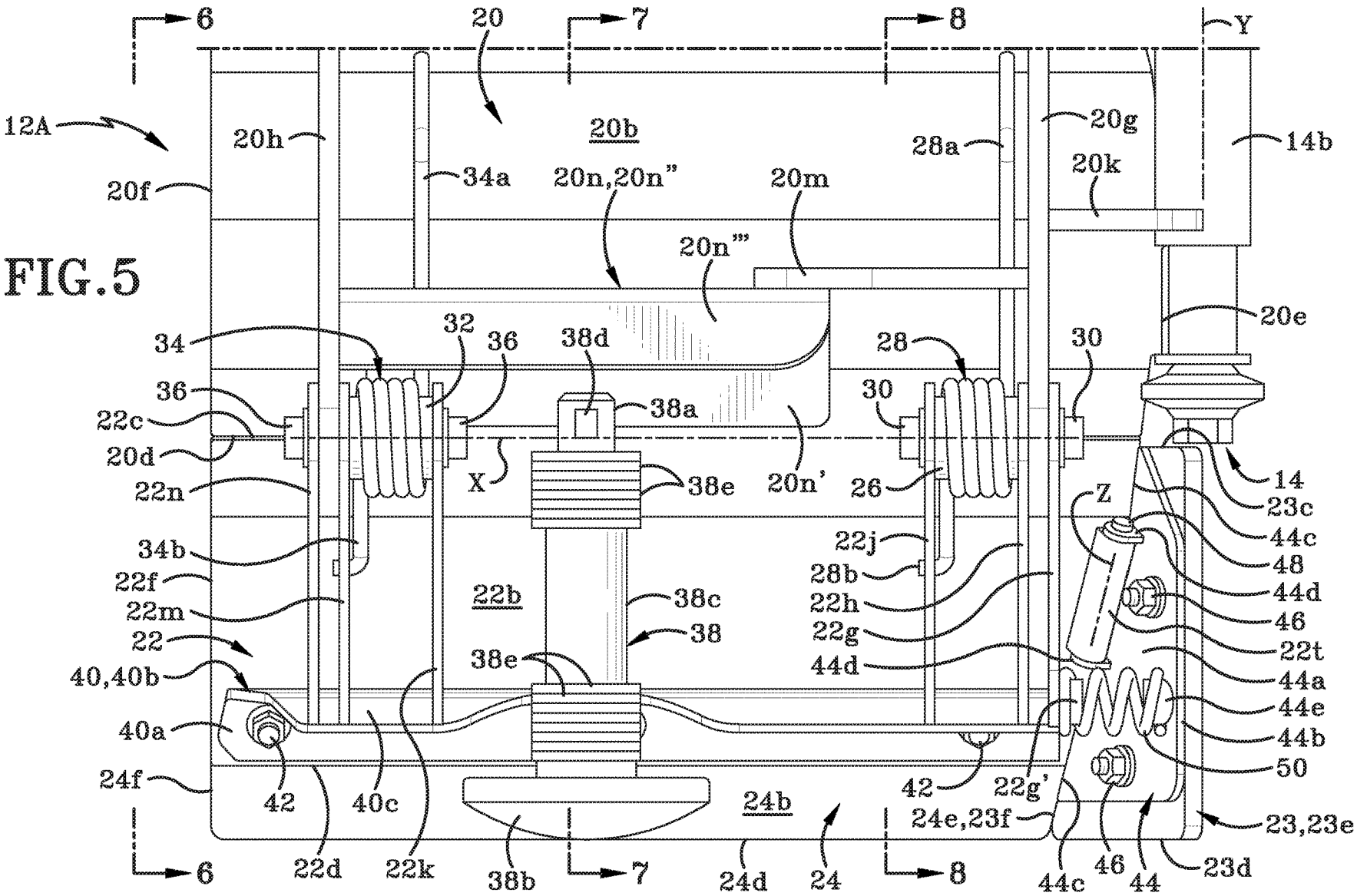
FIG. 5 is a partial rear elevation view of the left wing of the blade with the skid shoe partially removed for clarity of illustration.
Figure 6:
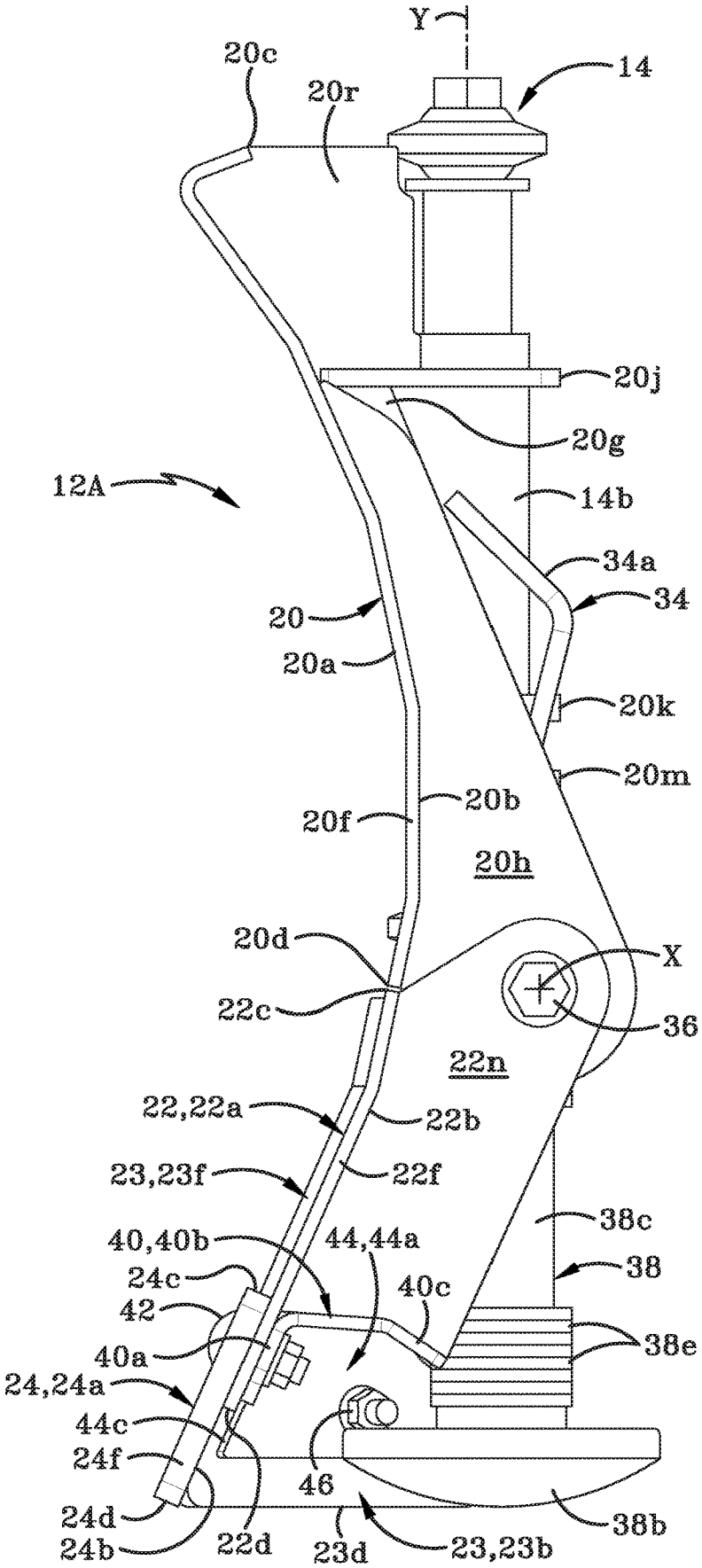
FIG. 6 is a left side elevation view of the left wing of the blade taken along line 6-6 of FIG. 5.

Referring still to FIGS. 2 to 8 and 10A to 11B, lower section 22 is a generally rectangular member that is substantially concavely-curved when viewed from the left side, as in FIG. 6. When V-blade 12 is in an untripped or non-tripped condition, such as is illustrated in FIG. 6, the concave curvature of lower section 22 of the moldboard generally follows the radius of curvature of the upper section 20 thereof. Lower section 22 has a front surface 22*a*, a rear surface 22*b* (FIG. 5), a top edge 22*c*, a bottom edge 22*d*, a first side 22*e*, and a second side 22*f*.

Referring to FIG. 5, lower section 22 includes a first bracket 22*g*, a second bracket 22*h*, a third bracket 22*j*, a fourth bracket 22*k*, a fifth bracket 22*m*, a sixth bracket 22*n*, and a seventh bracket 22*p* (FIG. 7). Brackets 22*g* through 22*p* are welded to rear surface 22*b* of lower section 22 and extend rearwardly therefrom. All of the brackets 22*g* through 22*p* are vertically oriented and are laterally spaced from one another. Each of the first bracket 22*g*, second bracket 22*h*, third bracket 22*j*, fourth bracket 22*k*, fifth bracket 22*m*, and sixth bracket 22*n* extends generally from proximate top edge 22*c* of lower section 22 to proximate bottom edge 22*d* thereof. First bracket 22*g* and second bracket 22*h* are located a distance laterally apart that is sufficient to receive a rearward lower region of first plate 20*g* of upper section 20 therebetween. This rearward lower region of first plate 20*g* is the part of first plate 20*g* that overlaps the upper region of lower section 22. Third bracket 22*j* is located a distance laterally away from second bracket 22*h* and the spacing between second bracket 22*h* and third bracket 22*j* is greater than the spacing between first bracket 22*g* and second bracket 22*h*. This arrangement can readily be seen in FIG. 5. Fourth bracket 22*k*, fifth bracket 22*m*, and sixth bracket 22*n* are arranged in a similar fashion to first, second and third brackets 22*g*, 22*h*, 22*j* but are grouped as a mirror image of first, second, and third brackets 22*g*, 22*h*, 22*h*. The spacing between fifth bracket 22*m* and sixth bracket 22*n* is sufficient to receive the rearward lower region of second plate 20*h* of upper section 20 therebetween. The rearward lower region of second plate 20*h* is the part of second plate 20*h* that overlaps the upper region of lower section 22. The spacing between fourth bracket 22*k* and fifth bracket 22*k* is similar to the spacing between second bracket 22*h* and third bracket 22*j*. Aligned holes are defined between the inner and outer surfaces of first bracket 22*g*, first plate 20*g*, second bracket 22*h*, and third bracket 22*j*. Similarly, aligned holes are defined between the inner and outer surfaces of fourth bracket 22*k*, fifth bracket 22*m*, second plate 20*h*, and sixth bracket 22*n*. The aligned holes are generally aligned along the plane where bottom edge 20*d* of upper section 20 is adjacent top edge 22*c* of lower section 22 (when lower section 22 is urged into vertical alignment with upper section 20). First bracket 22*g* through sixth bracket 22*n* are all substantially identical in structure and function to one another.

Seventh bracket 22*p* is different in configuration from all of the first bracket 22*g* through to the sixth bracket 22*n*. Seventh bracket 22*p* is located between third bracket 22*j* and fourth bracket 22*k*. In the illustrated embodiment, seventh bracket 22*p* is located closer to fourth bracket 22*k* than to third bracket 22*j*. The purpose of seventh bracket 22*p* will be discussed later herein.

Figure 9:
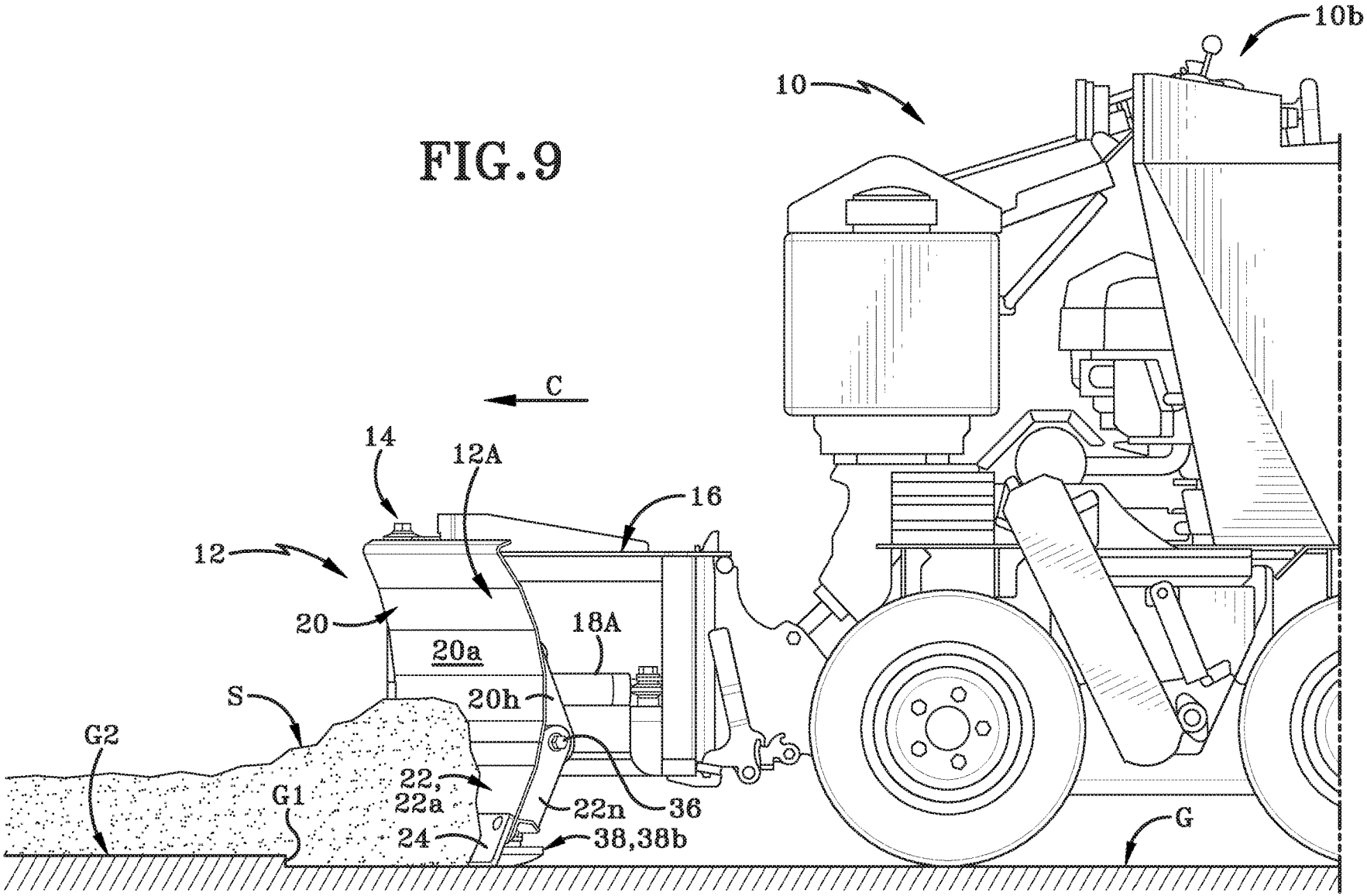
FIG. 9 is a partial left side elevation view of the snowplow in use and showing the blade traveling along a surface removing snow, and further showing a solid obstacle a distance in front of the blade.

Each of the first wing 12A and second wing 12B of blade 12 is provided with a biasing assembly (FIG. 5) that urges the lower section 22 of the associated wing into alignment with the upper section 22 thereof so that blade 12 may be utilized to clear snow from a surface "G" as shown in FIG. 9. Stated otherwise, biasing assembly urges the trip edge into alignment with the upper section 22 of the moldboard. In the illustrated embodiment, the biasing assembly is a spring assembly, particularly a torsion spring assembly. It will be understood that in other embodiments, other types of biasing assembly or biasing mechanisms may be utilized instead of the illustrated torsion spring assembly. Any suitable mechanisms may be utilized that perform this same biasing function as the illustrated torsion spring assembly.

The illustrated torsion spring assembly includes a first sleeve 26 (FIGS. 5 and 8) that extends between second bracket 22*h* and third bracket 22*j*. A first torsion spring 28 circumscribes first sleeve 26 and fasteners 30 secure first sleeve 26 and thereby first torsion spring 28 to first bracket 22*g*, second bracket 22*h*, and third bracket 22*j*. First torsion spring 28 has a first end 28*a* and a second end 28*b* that extend outwardly from the spring in opposite directions. First end 28*a* extends through the aperture 20*p* (FIG. 3) in third plate 20*m* and contacts rear surface 20*b* of upper section 20. Second end 28*b* extends downwardly from first torsion spring 28 and extends laterally through a hole 22*s* (FIG. 8) through third bracket 22*j*.

The torsion spring assembly further includes a second sleeve 32 (FIG. 5) that extends between fourth bracket 22*k* and fifth bracket 22*m*. A second torsion spring 34 circumscribes second sleeve 32 and fasteners 36 secure second sleeve 32 and thereby second torsion spring 34 to fourth bracket 22*k*, fifth bracket 22*m*, and sixth bracket 22*n*. Second torsion spring 34 has a first end 34*a* and a second end 34*b* that extend outwardly from the spring in opposite directions. First end 34*a* extends through the aperture 20*q* (FIG. 3) defined in second leg 20*n*" of U-shaped plate 20*n* and contacts rear surface 20*b* of upper section 20. The second end 34*b* extends downwardly from second torsion spring 34 and extends laterally through a hole (not shown) through fifth bracket 2*m*. This arrangement is shown in FIG. 5.

The first ends 28*a* and 34*a* of the first and second torsion springs 28, 34 contact the rear surface 20*b* of the upper section and apply spring force thereto. The second ends 28*b* and 34*b* of the first and second torsion springs 28, 34 are fixedly engaged with the third bracket 22*j* and fifth bracket 22*m*, respectively, and thereby with the rear surface 22*b* of lower section 22. The second ends 28*b* and 34*b* apply spring force to lower section 22 and thereby bias lower section 22 and thereby the entire trip edge forwardly and into alignment with upper section 20. The spring force applied by the torsion spring assembly to keep the trip edge aligned with the upper section 20 of the moldboard is sufficient to ensure that the blade 12 is capable of clearing snow "S" (FIG. 9) from a surface "G" without the trip edge tripping. The trip edge will only trip when blade 12 encounters an obstacle "G1" of a sufficient size that an impact of the wing 12A or 12B, or the entire blade 12 with the obstacle will overcome the spring force provided by the torsion spring assembly.

Referring to FIGS. 1 and 6, left wing 12A includes a skid shoe 38 that aids in keeping cutting edge 24 slightly off the surface "G" to be cleared. Skid shoe 38 is operatively engaged with seventh bracket 22*p* of lower section 22 and is particularly useful when blade 12 is used to clear snow from gravel driveways or roadways. In particular, skid shoe 38 may be utilized to raise or lower the blade 12 relative to the surface "G". As best seen in FIG. 6, skid shoe 38 includes a central rod 38*a* that has an enlarged curved shoe 38*b* provided at a lower end thereof. Rod 38*a* passes through a central bore of a skid shoe mount 38*c* that is welded to the trailing edge of seventh bracket 22*p*. Shoe 38*b* is located below the skid shoe mount 38*c* and a section of rod 38*a* extends outwardly beyond an upper end of skid shoe mount 38*c*. Shoe 38*b* is of a greater diameter than the diameter of the central bore of skid shoe mount 38*c*. A through-hole (not shown) is defined in the section of rod 38*a* that extends outwardly beyond the upper end of skid shoe mount 38*c*. A pin 38*d* is removably inserted through the through-hole to prevent rod 38*a* from being withdrawn downwardly through skid shoe mount 38*c*.

A plurality of removable washers 38*e* is received around rod 38*a* in locations above and below skid shoe mount 38*c*. The operator of vehicle 10 is able to set the distance between shoe 38*b* and the lower end of skid shoe mount 38*c* by changing the number of washers 38*e* located between shoe 38*b* and the lower end of skid shoe mount 38*c*. As illustrated in FIG. 7, eight washers 38*e* are located below skid shoe mount 38*c* and eight washers 38*e* are located above skid shoe mount 38*c*. If the operator wishes to raise blade 12 off the ground to a greater extent, he or she will remove pin 38*d* and slide rod 38*a* downwardly and out of skid shoe mount 38*c*. An additional number of washers 38*e* that are illustrated as currently being located above skid shoe mount 38*c* in FIG. 7 will then be placed on top of the washers 38*e* which are currently illustrated as located below skid shoe mount 38*c*. The rod 38*a* is then reinserted through the bore of skid shoe mount 38*c* and pin 38*d* will be reengaged in the through-hole. Lowering the blade 12 will involve removing some of the washers 38*e* from below the skid shoe mount 38*c* and placing them above the skid shoe mount 38*c*. The ground-contacting surface of shoe 38*b* may be coated with a friction-reducing material to allow shoe 38*b* to slide relatively easily over surface "G". Because skid shoe 38 is engaged with seventh bracket 22*p*, skid shoe 38 will move in unison with lower section 22 of the moldboard. In other words, skid shoe 38 will move in unison with the trip edge on blade 12.

As indicated earlier herein, the trip edge includes a snow shield 23 (FIG. 2) that is a generally truncated triangular shape when viewed from the front. Since the shield 23 of right wing 12B is shown with greater clarity in FIG. 2, the various features of the shield 23 of each of the left and right wings 12A, 12B will be discussed with reference to the right wing 12B shown in that figure and the left wing 12A shown in FIG. 5. Shield 23 has a front surface 23*a* (FIG. 2), a rear surface 23*b* (FIG. 5), a top edge 23*c*, a bottom edge 23*d*, a first side edge 23*e*, and a second side edge 23*f*. Second side edge 23*f* of shield 23 is positioned adjacent first side edge 22*e* of lower section 22 and is inclined rearwardly therefrom and inwardly towards vertical axis "Y". In particular, shield 23 is oriented at an obtuse angle relative to lower section 22. The first side edges 23*e* of the two shields 23 are located adjacent one another and generally along vertical axis "Y". This can be seen in FIG. 4. At least a part of each shield 23 is generally aligned with central hinge 14 when the trip edge is in an untripped condition.

Cutting edge 24 of left wing 12A is shown in FIGS. 2, 5. and 7 to include a front surface 24*a*, a rear surface 24*b*, a top edge 24*c*, a bottom edge 24*d*, a first side edge 24*e*, and a second side edge 24*f*. An upper region of cutting edge 24 overlaps a bottom region of lower section 22.

Figure 11A:
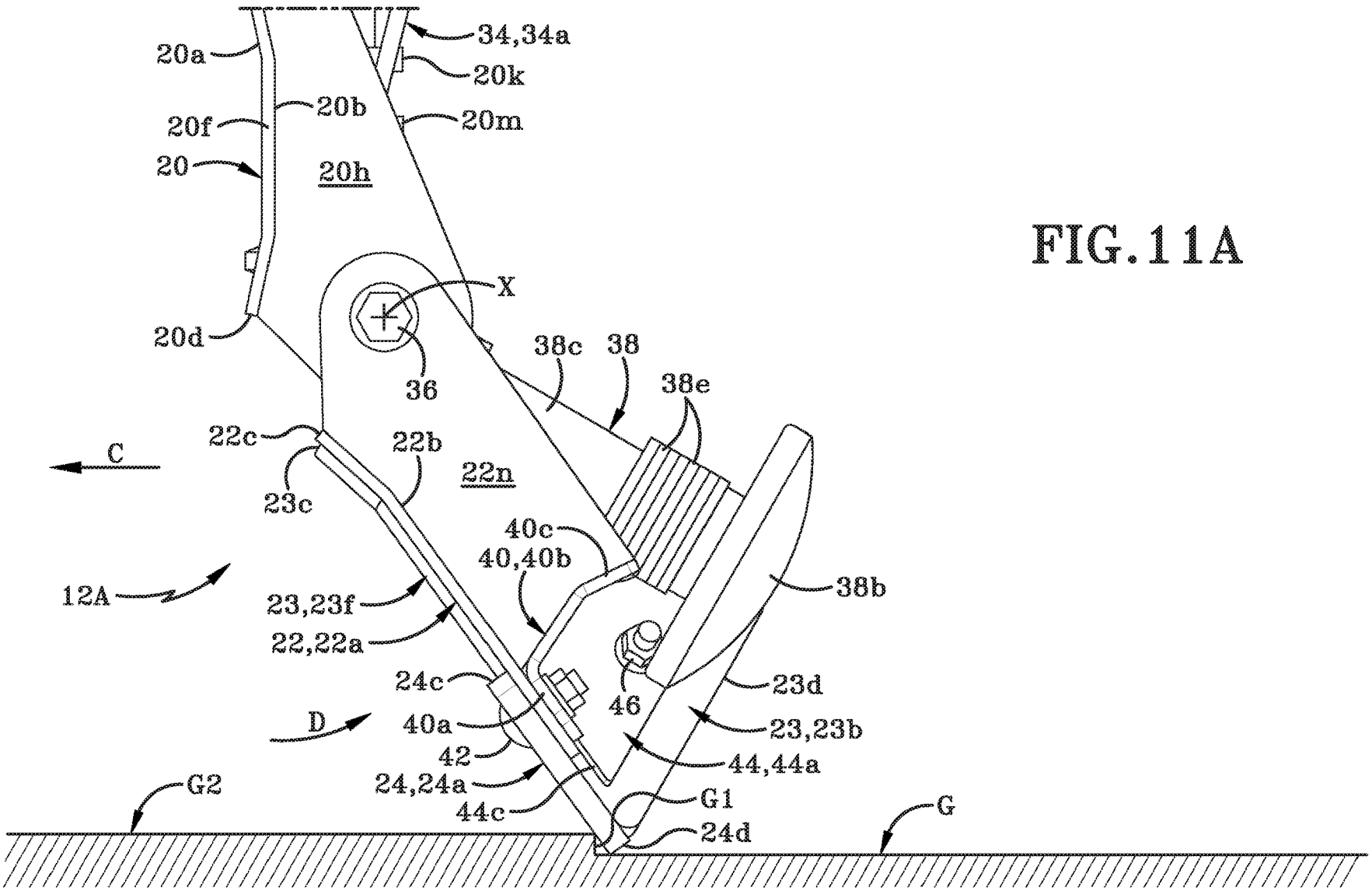
FIG. 11A is a partial, enlarged left side elevation view showing the lower section of the left wing tripping as it encounters the obstacle on the surface.
Figure 11B:
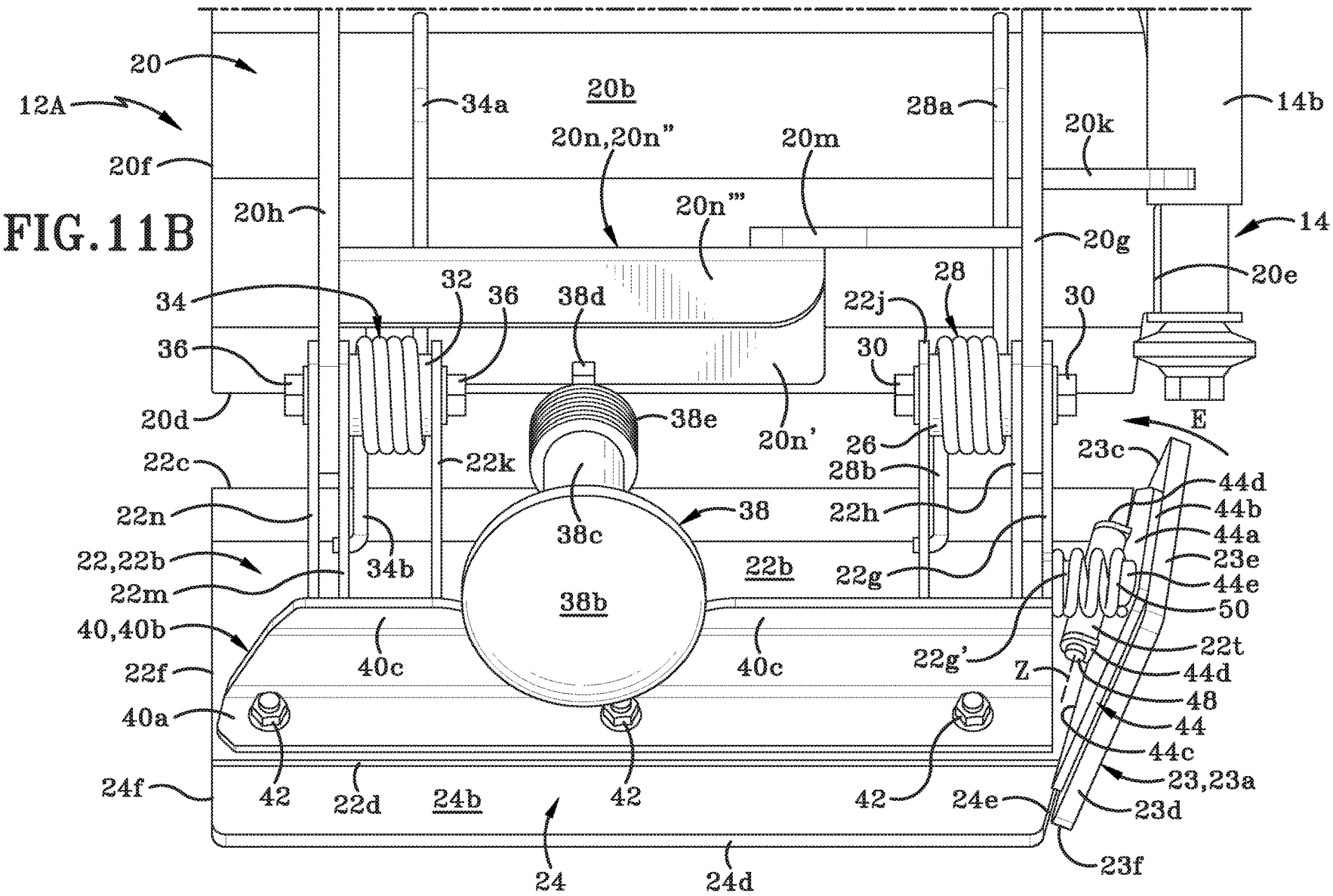
FIG. 11B is a rear elevation view of the blade shown in FIG. 11A showing the pivotal motion of the snow shield relative to the rest of the trip edge. The fasteners which secure the mounting plate to the snow shield have been omitted from this figure for clarity of illustration.

As best seen in FIGS. 5, 7, and 11B, a base plate 40 is provided proximate a lower region of lower section 22 and an upper region of cutting edge 24. Base plate 40 includes a first leg 40*a* that extends for a distance upwardly along the rear surface 22*b* of lower section 22 from proximate the bottom edge 22*d* thereof. A plurality of fasteners 42 secure first leg 40*a* of base plate 40 to the upper region of cutting edge 24 and a lower region of lower section 22. Base plate 40 further includes a second leg 40*b* that extends outwardly and rearwardly from an upper end of first leg 40*a*. Second leg 40*b* is oriented at an obtuse angle (slightly over 90 degrees) relative to first leg 40*a*. A third leg 40*c* extends outwardly from a rear end of second leg 40*b* and angles rearwardly and downwardly therefrom. Third leg 40*c* is oriented at an acute angle (less than 90 degrees) relative to an upper surface of second leg 40*b*. First, second, third, and fourth, fifth, sixth, and seventh brackets 22*g* through 22*p* terminate adjacent base plate 40. Base plate 40 extends from proximate first side 22*e* of lower section 22 to proximate second side 22*f* thereof. This arrangement is shown in FIG. 5. It should be noted that base plate 40 is notched to accommodate skid shoe 38.

A mounting plate 44 (FIGS. 5 and 10B) is secured to snow shield 23 by a plurality of fasteners 46. Mounting plate 44 is provided to strengthen snow shield 23. Mounting plate 44 is of a generally similar shape to snow shield 23 but is smaller in dimension. Mounting plate 44 has a front surface (not numbered), a rear surface 44*a*, a first side edge 44*b*, and a second side edge 44*c*. The front surface of mounting plate 44 is placed in abutting contact with the rear surface 23*b* of snow shield 23 and in such a way that the second side edge 44*c* of plate 44 is substantially aligned with the second side edge 23*f* of snow shield 23. A pair of flanges 44*d* extend outwardly from the rear surface 44*a* of mounting plate 44 in a region proximate second side edge 44*c*. Flanges 44*d* are vertically spaced a distance apart from each other. Although not illustrated herein, it will be understood that each flange 44*d* defines a hole therein that extends between the upper and lower surfaces of the flange 44*d*.

A mounting cylinder 22*t* extends is provided on rear surface 22*b* of lower section 22 proximate first side edge 22. Mounting cylinder 22*t* is shaped and sized to be received between the two vertically-spaced apart flanges 44*d* provided on mounting plate 44. Mounting cylinder 22*t* defines a bore (not shown) therein that extends from an upper end of the cylinder 22*t* to a lower end thereof. When mounting cylinder 22*t* is received between the flanges 44*d*, the bore of mounting cylinder 22*t* is aligned with the holes defined in each of the two flanges 44*d*. A pivot pin 48 is inserted through the aligned holes in flanges 44*d* and mounting cylinder 22*t* and the pin 48 secures snow shield 23 to lower section 22. In particular, snow shield 23 is pivotally mounted to lower section 22 by way of the mounting cylinder 22, flanges 44*d* and pin 48.

Figure 10A:
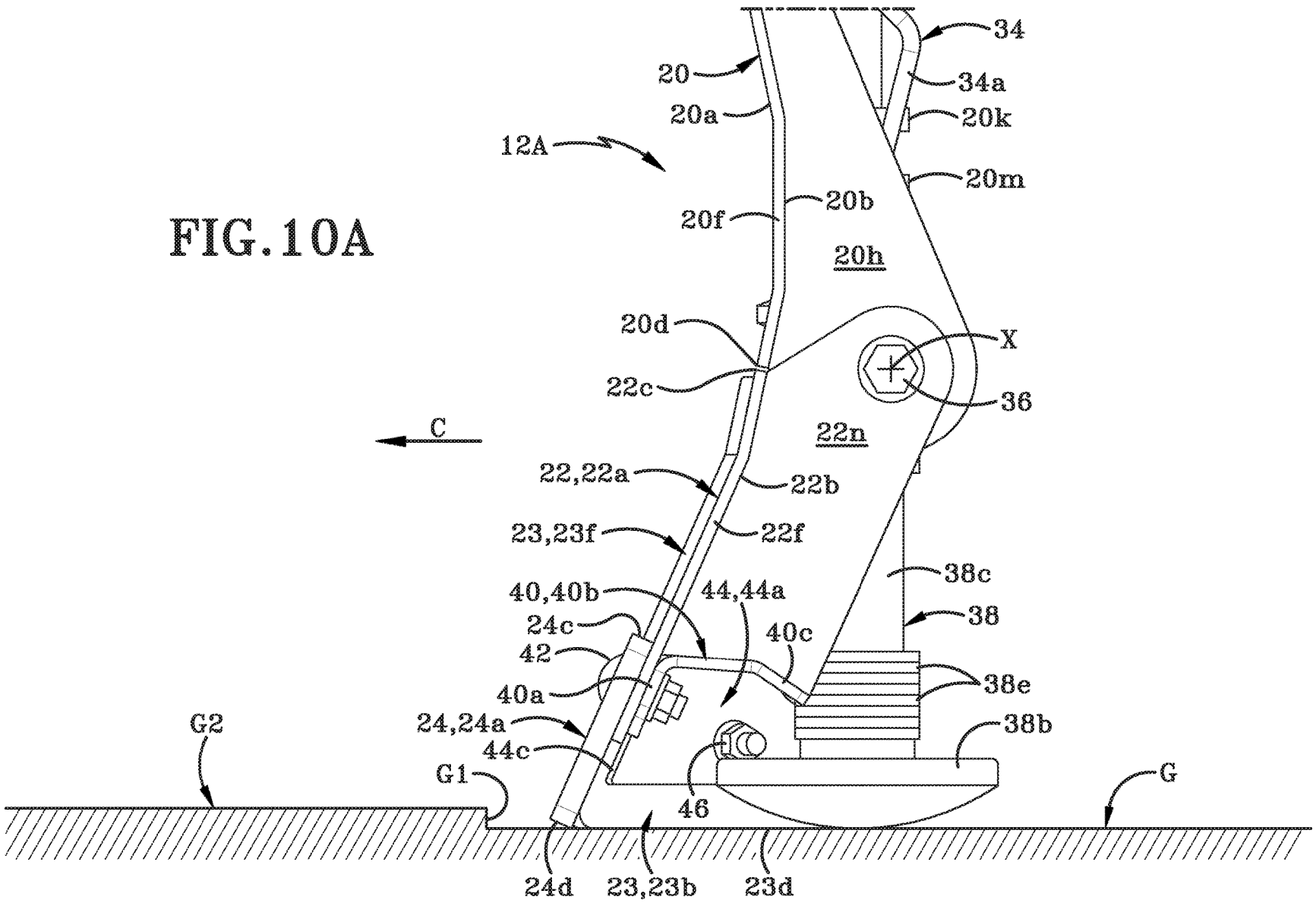
FIG. 10A is a partial, enlarged left side elevation view showing the position of the blade when in contact with the surface and immediately before reaching the obstacle on the surface; and wherein the snow has been removed for clarity of illustration.
Figure 10B:
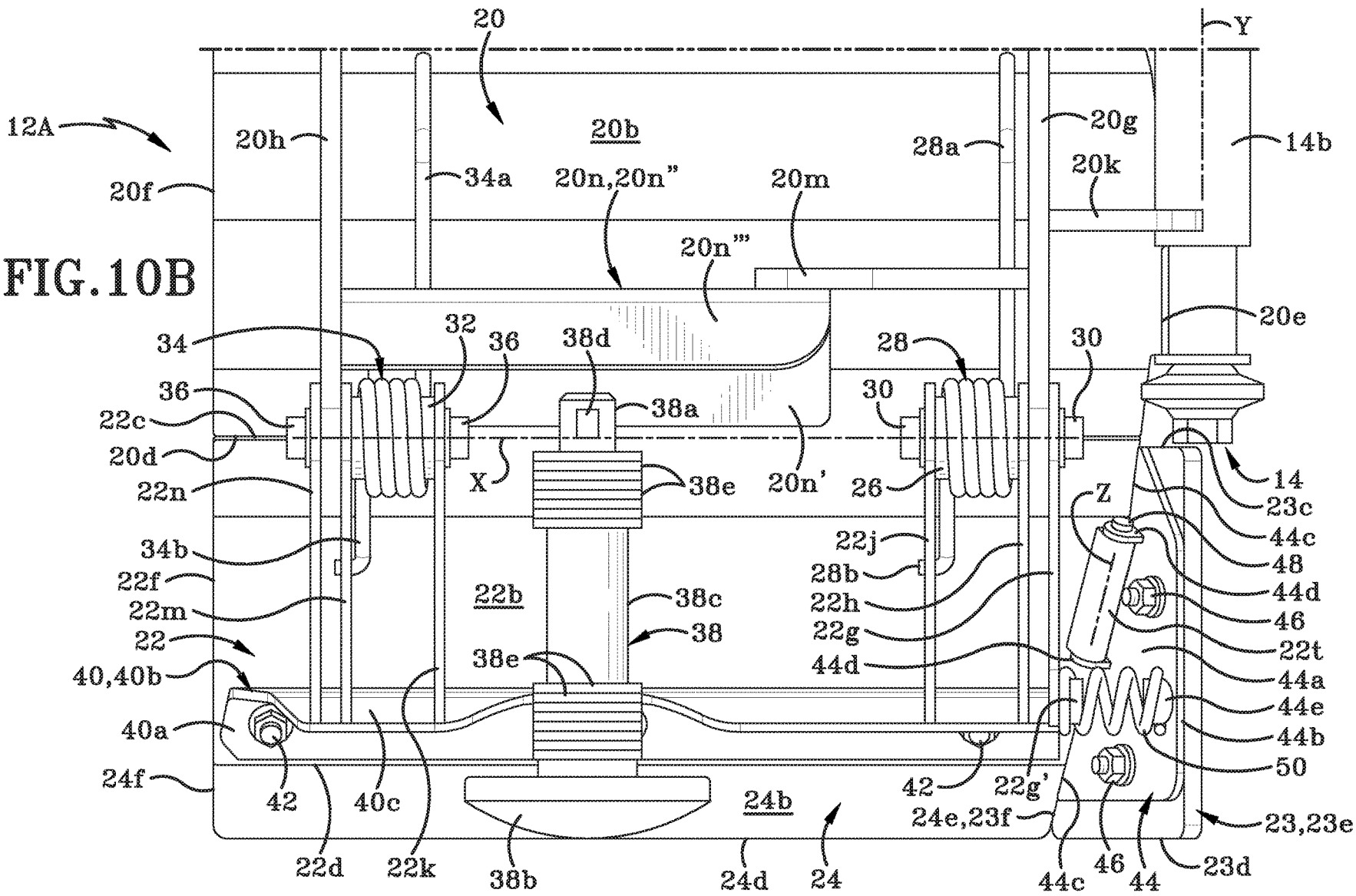
FIG. 10B is a rear elevation view of the blade shown in the position illustrated in FIG. 10A.

Referring still to FIGS. 5 and 10B, a coil spring 50 extends between a nubbin 44*e* on rear surface 44*a* of mounting plate 44 and a nubbin 22*g*' extending outwardly from first bracket 22*g* on lower section. A first end (not numbered) of coil spring 50 is operatively engaged with nubbin 44*e* on mounting plate 44 and a second end (not numbered) of coil spring 50 is operatively engaged with nubbin 22*g*' of first bracket 20*g*. Nubbins 44*e* and 22*g*' keep spring secured between mounting plate 44 and lower section 22. In accordance with the present disclosure, snow shield 23 is urged by spring 50 into the first position or a "use position" (FIGS. 2 and 10B).

Snow shield 23 is configured to pivot about a pivot axis "Z" (FIGS. 5, 10B and 11B) that extends along the shaft of pin 48. Snow shield 23 is able to pivot about the pivot axis "Z" relative to the rest of the trip edge. In particular, the snow shield 23 is able to pivot relative to the lower section 22 of the moldboard between a first position (FIG. 10B) and a second position (FIG. 11B). The pivot axis "Z" is oriented parallel to first side 22*e* of lower section 22. It should be noted that the pivot axis "Z" is also oriented parallel to second side 23*f* of snow shield 23 and to the first side 24*f* of the cutting edge 24. The spring 50 urges snow shield 23 into the first position, i.e., into a position where the snow shield 23 will contact the surface "G" and assist in clearing snow from a surface "G" (FIG. 9). When blade 12 is being used to remove snow "S" (FIG. 9) from the surface "G", the entire trip edge is biased or urged into general vertical alignment with upper section 20 and the snow shield 23 is urged into the first position. When a trip event occurs because an obstacle "G1" is impacted by blade 12, the trip edge will trip and will pivot about the horizontal axis "X" and into the second position (FIG. 11B). When snow shield 23 pivots from the first position to the second position, the snow shield 23 moves away from central hinge 14 and from the vertical axis "Y" extending therealong. Simultaneous tripping of the trip edges of left wing 12A and right wing 12B will cause the snow shields 23 of the two wings to impinge upon each other as the gap between the pivoting trip edges narrows. This impingement may interfere with the pivotal motion of the trip edges about their associated axes "X" and may lead to damage of the trip edges, and particularly to damage to the snow shields 23. As the snow shields 23 impinge upon each other, they will tend to push off of one another. The pushing force will tend to cause shield 23 of left wing 12A to pivot about the associated pivot axis "Z" away from the snow shield 23 of right wing 12B as indicated by arrow "E" in FIG. 11B. A similar pivotal motion of the snow shield 23 of the right wing 12B about its associated pivot axis "Z" and away from the snow shield 23 of the left wing 12A in the opposite direction to arrow "E" will also occur. Because of the pivotal motion of the shields 23 about their associated axes "Z" as the trip edge pivots about axis "X", shield 23 of left wing 12A will translate out of contact with the shield 23 of right wing 12A and vice versa. As a consequence of the snow shields 23 pivoting away from each other, the gap between the first sides 23*e* of the two snow shields 23 increases in width and the two trip edges are therefore momentarily able to pivot away from the surface "G", "G1", "G2" without further contact with each other. The pivotal motion of the trip edges 22, 23, 24 about their associated axes "X" will therefore tend to not be impeded and the chance of damage occurring to those two trip edges will tend to be reduced.

When cutting edge 24 is engaged with lower section 22 by fasteners 42, the bottom region of cutting edge 24 extends downwardly for a distance below the bottom end 22*d* of lower section 22. As best seen in FIG. 5, a bottom edge 24*d* of cutting edge 24 and the bottom edge 23*d* of shield 23 are substantially coplanar and comprise the regions of blade 12 that may contact the surface "G" when blade 12 is used to clear materials such as snow from the surface "G".

Having now described the various components of V-blade 12, an exemplary method of using the blade 12 is now described in particular reference to FIGS. 9 to 12. As indicated earlier herein, blade 12 is mounted to a front end of vehicle 10 by hitch assembly 16. Hitch assembly 16 not only secures blade 12 to vehicle 10 but is also the mechanism through which blade 12 is manipulated in order to clear snow "S" from a surface "G", "G1", and "G2".

An operator stands on platform 10*a* (FIG. 1) of vehicle 10 and operates vehicle 10 and blade 12 through manipulating controls 10*b*. Vehicle 10 is driven forwardly over the surface "G" in the direction indicated by arrow "C" in FIG. 9. Blade 12 is positioned to remove snow "S" from the surface "G". In other words, blade 12 is lowered via actuation of the hitch assembly 16 so that bottom edge 24*d* of cutting edge 24 and bottom edge 23*d* of snow shield 23 of each of the left and right wings 12A, 12B of blade 12 are placed on the surface "G" or just slightly above surface "G". The actual height of bottom edges 23*d*, 24*d* is set utilizing the skid shoes 38, as has been previously described herein.

As the vehicle 10 continues to move in the direction "C", snow is captured by the curved blade 12 and is pushed forwardly in front of blade 12 and thereby removed from the surface "G".

FIG. 10A shows blade 12 again but the snow has been removed from the figure for clarity of illustration. Both the bottom 24*d* of cutting edge 24 and the bottom 23*d* of shield 23 are in contact with the surface "G" or in close proximity thereto as blade 12 travels with utility vehicle 10 in the direction "C". Additionally, the shoe 38*b* of skid shoe 38 slides along surface "G". If the operator wishes to lift the bottom edges 24*d*, 23*d* further off the surface "G", he or she will adjust the distance of the blade 12 from the surface "G" by increasing the number of washers 38*e* below skid shoe mount 38*c*. Increasing the number of washers 38*e* will lift the cutting edge 24 and snow shield 23 slightly further off the surface "G" but the shoe 38*b* of the skid shoe 38 will continue to slide over the surface "G". If the operator finds the blade 12 is not adequately clearing snow "S" from surface "G", he or she can remove one or more washers 38*e* from the group of washers 38*e* below the skid shoe mount 38*c*. The removal of one or more washers 38*e* will lower the blade 12, moving it closer to the surface "G" and thereby bring bottom ends 24*d*, 23*d* into better contact with surface "G". Shoe 38*b* of skid shoe 38 will continue to slide across the surface "G" as before.

FIGS. 10A and 10B show that the surface "G" has an obstacle "G1" at a location a distance in front of the vehicle 10 and the left wing 12A of blade 12 is in a working position where the blade 12 is able to be used for snow removal. In this particular instance, the obstacle "G1" is in the form of raised region of the roadway or sidewalk along which the vehicle 10 is moving. In particular, the elevation of the roadway or sidewalk changes from a first elevation "G" to a second elevation "G2" at the obstacle "G1". It will be understood that the illustrated obstacle "G1" is exemplary of any type of solid obstacle that may lay in the path of the moving blade 12. The obstacle "G1" is sufficiently raised relative to the surface "G" that if the blade 12 strikes it and does not trip, the impact could damage blade 12.

In accordance with an aspect of the present disclosure and in order to aid in preventing or limiting impact damage to blade 12, the trip edges on the blade (i.e., the components 22, 23, and 24 of one or both wings 12A, 12B) are designed to trip. The term "trip" is used herein to describe the pivotal motion of the lower section 22, snow shield 23, and cutting edge 24, in unison, relative to the upper section 20 of the moldboard and about axis "X". This tripping action occurs when the bottom edge 24*d*, 23*d* encounters the transition "G1". The pivoting tripping action is indicated in FIG. 11A by the arrow "D". When the trip edge pivots, it does so about the horizontal axis "X" that extends along the first and second sleeves 26, 32 (FIG. 10B) of torsion spring assembly. As can be seen in FIG. 11A, pivotal motion in the direction of arrow "D" moves the trip edge 22, 23, 24 out of alignment with the upper section 20 of the moldboard. The tripping motion helps the blade skip over the obstacle "G1", therefore avoiding impact or limiting damage thereto. The pivotal motion winds up torsion springs 28, 34.

Simultaneous pivoting of the trip edge, i.e., lower section 22, snow shield 23, and cutting edge 24, on both wings 12A, 12B also causes a substantially simultaneous pivoting motion in one or both snow shields 23. In particular, if, as the trip edges pivot, the snow shield on the left wing 12A contacts the snow shield 23 on the right wing 12B, then one or both snow shields 23 will pivot along the associated pivot axis "Z" (FIG. 11B). This pivotal motion is indicated in FIG. 11B by the arrows "E". As the snow shield 23 pivots, the coil spring 50 is compressed in overall length. This can be seen by comparing FIGS. 10B and 11B. The snow shield 23 pivots away from the longitudinal axis "Y" and towards the second side 22*f* of lower section 22. The pivoting motion in the direction "E" breaks contact between the two snow shields 23 and therefore the pivoting motion of the trip edges in the direction "D" can occur without interfering with each other. It will be understood that the snow shield 23 of right wing 12B will pivot away from the longitudinal axis "Y" and in an opposite direction to the snow shield 23 of left wing 12A, thus increasing a lateral distance between the first side edges 23*e* of the two snow shields 23. The two snow shields 23 on the left and right wings 12A, 12B therefore do not interfere with one another as the trip edges of the left and right wings 12A, 12B pivot in the direction "D". Additionally, as the trip edge of left wing 12A (or right wing 12B) trips and pivots, the skid shoe 38 thereon will be lifted off the surface "S".

Figure 12:
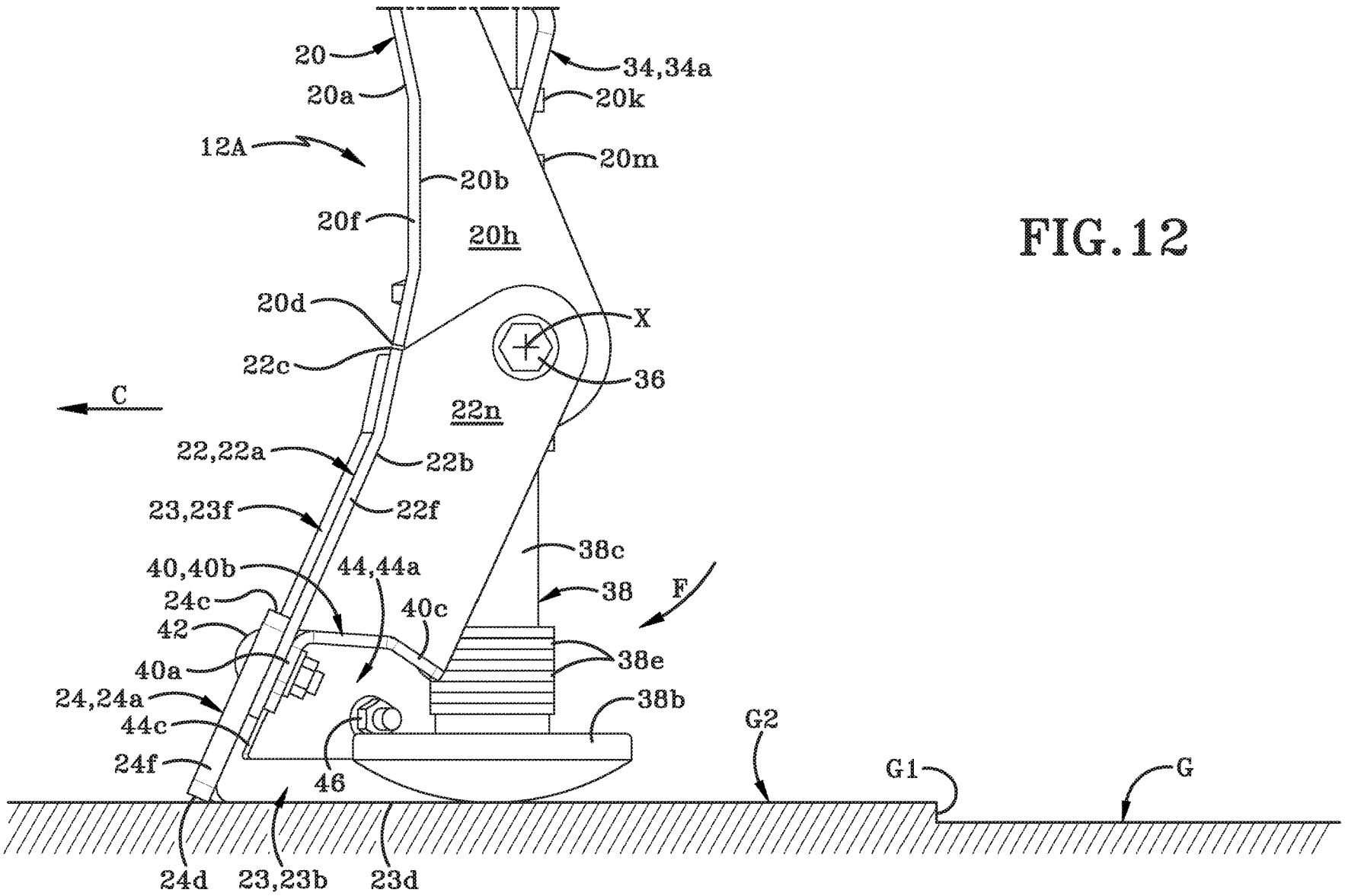
FIG. 12 is a partial left side elevation view of the lower section of the left wing returning to its original position.

Utility vehicle 10 will continue moving forwardly in the direction of arrow "C" and as soon as the trip edge has pivoted about the horizontal axis "X" and the snow shields 23 have pivoted about the pivot axis "Z", the spring force exerted by the torsion springs 28, 34 will cause the trip edge to automatically return to its original position where the lower section 22 is vertically aligned with upper section 20. Effectively, the "trip event" is over and the trip edge returns to a position where it effectively aids the upper section 20 of the moldboard to remove snow from the surface "G2". In particular, the first and second torsion springs 28, 34 will return to their at-rest position and as they do so, the second ends 28*b*, 34*b* thereof will push on the rear surface 22*b* of lower section 22 by way of brackets 22*j* and 22*m*, forcing the lower section to pivot in the direction "F" (FIG. 12). Shield 23 and cutting edge 24 will pivot in unison with lower section 22 about the horizontal axis "X". This pivotal motion "F" is in the opposite direction to the pivotal motion "D" caused by the tripping of the blade 12. The pivotal motion in the direction "F" will continue until lower section 22 returns to its at-rest position shown in FIG. 6 where it is generally vertically aligned with upper section 20 of the moldboard.

At substantially the same time that the lower section 22, shield 23, and cutting edge 24 are pivoting in the direction "F" about longitudinal axis "X", the coil spring 50 will begin to return to its at-rest position (i.e., from the position shown in FIG. 11B to the position shown in FIG. 10B). As the coil spring 50 expands, it will pivot the snow shield 23 back towards the central hinge 14. It will be understood that the shield 23 on right wing 12B may simultaneously pivot in the opposite direction towards central hinge 14. In other words, the snow shields 23 of the left and right wings 12A, 12B will each pivot back towards the central hinge 14 and towards each other, returning to the orientation they were in before the impact with the obstacle "G1" and before the trip event.

The pivoting of the lower section 22, shield 23, and cutting edge 24 in the direction "F" will also bring skid shoe 38 once again back into contact with surface "G". Continued motion of the vehicle 10 in the direction indicated by arrow "C" will allow blade 12 to continue to remove snow "S" from the surface. That surface is now the elevated surface "G2".

As indicated earlier herein, the left wing 12A and right wing 12B are capable of articulating relative to one another about central hinge 14. The operator will utilize the control panel 10*b* on vehicle 10 to manipulate the left and right wings 12A, 12B to the desired orientation relative to one another to effectively remove snow "S" from surface "G" or "G2". In other words, the wings 12A, 12B can form an inverted V-shape, a straight blade shape, or a V-shape or any shape therebetween. In any of these instances, should another trip event occur, the pivoting trip edge 22, 23, 24 and the translating snow shield 23 (i.e., the pivot snow shield 23) will ensure there is little likelihood of damage occurring to the cutting edge 24 and snow shields 23 through inadvertent contact between the two wings 12A, 12B.

A method of using blade 12 in accordance with the present disclosure, as will be summarized hereafter, helps to ensure that the blade 12 will be less likely to be damaged if it impacts an obstacle "G1" while being used to clear snow off a surface "G". The method includes providing a trip edge 22, 23, 24 on a moldboard 20 of each of a left wing 12A and a right wing 12B of the V-blade 12; biasing the trip edge 22, 23, 24 into alignment with the upper section 20 of the moldboard with a torsion spring assembly, biasing a show shield 23 on the trip edge 22, 23, 24 toward a central shaft 14; impacting an obstacle "G1" on a surface "G" with the trip edge 22, 23, 24; pivoting (in a direction "D"—FIG. 11A) the trip edge 22, 23, 24 relative to the upper section 20 of the moldboard about a horizontal axis "X" when the trip edge impacts the obstacle "G1"; and simultaneously translating the snow shield 23 away from the central shaft 14 and about an axis "Z" and relative to the lower section 22 of the moldboard. The translating of the two snow shields 23 away from each other occurs when the snow shields 23 begin to contact each other as the trip edges pivot. The pivoting of the snow shields 23 in a first direction "E" includes pivoting the snow shield 23 away from a central shaft 14 with which each of the left wing 12A and right wing 12B are engaged. The pivoting of the trip edge 22, 23, 24 and the translation or pivoting of the snow shield 23 away from the central shaft 14 stores potential spring force in the torsion spring assembly 28, 24 and coil spring 50, respectively.

The snowplow 10 will continue to move forwardly in the direction "C" and beyond the obstacle "G1". Substantially immediately after the trip edge 22, 23, 24 has pivoted in the direction "D" and the snow shield 23 has translated about the pivot axis "Z", the trip edge will start to pivot back to its original position under spring force exerted by the first and second torsion springs 28, 34; and the snow shield 23 will start to pivot back towards the central shaft 14 under spring force exerted as the coil spring. The pivoting of the trip edge in the direction "F" and translating of the snow shield 23 in the opposite direction to arrow "E" continues until the trip edge 22, 23, 24 is once again generally in alignment with the upper section 20 of the moldboard and the snow shield 23 is generally vertically aligned with at least part of the central hinge 14.

The method of using blade 12 further includes providing a snow shield 23 along a first side of the trip edge, i.e., the first side 22*e* of lower section 22 of the moldboard and at least partially beneath the central shaft 14. Having the snow shields 23 of the left wing 12A and right wing 12A able to translate away (i.e., pivot away) from one another in opposite directions by moving outwardly away from the central shaft 14 and relative to the associated lower section 22, helps to avoid interfering contact between the trip edge on the left wing 12A and the trip edge on the right wing 12B. In particular, the ability to pivot the snow shields relative to their associated trip edges helps to avoid interfering contact between the snow shield 23 provided on the left wing 12A and the snow shield 23 provided on the right wing 12B. The translating of the two snow shields 23 is effectively caused by each snow shield pushing the other snow shield away from it.

It will be understood, obviously, that if the obstacle "G1" is only in the path of one of the left wing 12A and right wing 12B, then only the trip edge 22, 23, 24 of that particular wing of the blade 12 will trip. If the obstacle "G1" extends across at least a portion of the roadway or sidewalk surface in front of both of the left wing 12A and right wing 12B, both trip edges 22, 23, 24 will trip, pivoting about the horizontal axis "X" and having the snow shields 23 thereon pivoting away from one another in order to avoid contact between the two snow shields 23. These motions aid in preventing damage to the trip edges and particularly to the snow shields 23 provided thereon.

While it has been described that left wing 12A and right wing 12B are engaged with central hinge 14 and are selectively pivotable relative to vertical axis "Y", it will be understood that in other embodiments, the upper sections 20 of the left and right wings 12A, 12B may be fixedly welded to a central shaft or post instead of to sleeves 14*a*, 14*b*, 14*c* of a central hinge 14. In these instances, the left and right wings of the blade 12 remain in a fixed orientation relative to one another and to the central shaft at all times. In these embodiments, the trip edge will be substantially as illustrated and described with respect to V-blade 12 and will function in the same way as described herein.

While it has been shown and described herein that the trip edge comprises the lower section 22 of the moldboard, the snow shield 23, and the cutting edge, in other embodiments, the snow shield 23 may be omitted from the trip edge. In some embodiments, the snow shield 23 may be omitted from the V-blade altogether. In other embodiments, the snow shield may be fixedly engaged with central hinge 14 or on a central shaft. The snow shield may then remain in a fixed orientation relative to the central hinge 14 or the central shaft at all times.

It will be understood that if cutting edge 24, base plate 40, and/or snow shield 23 on the left wing 12A or right wing 12B become damaged or worn down over time, the operator may simply remove the fasteners 42 and/or 46, disengage the damaged cutting edge 24, base plate 40, and/or snow shield 23 from the lower section 22 and install a new/replacement component. The new/replacement component will be secured to the lower section 22 by reengaging the fasteners 42 and/or 46.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment,"

or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A blade for a snowplow comprising:

a left wing and a right wing, wherein each of the left wing and the right wing includes:

a moldboard;

a trip edge; and a biasing assembly that biases the trip edge into alignment with the moldboard;

wherein when the trip edge is tripped by encountering an obstacle on a surface being cleared of snow by the blade, the biasing assembly enables the trip edge to pivot about a horizontal axis and relative to the moldboard;

wherein a portion of the trip edge is pivotally engaged with a rest of the trip edge and the portion of the trip edge pivots about a pivot axis relative to the rest of the trip edge when the trip edge trips;

wherein the portion of the trip edge is a snow shield;

wherein the snow shield of the left wing is located adjacent the snow shield of the right wing; and wherein the snow shields are configured to pivot away from each other when the trip edges on the left wing and the right wing are substantially simultaneously tripped.

2. The blade according to claim 1, wherein the rest of the trip edge comprises a first member; and wherein the snow shield is configured to pivot about a pivot axis relative to the first member between a first position and a second position.

3. The blade according to claim 2, wherein the first member has a first side; and wherein the pivot axis about which the snow shield pivots is oriented parallel to the first side of the first member.

4. The blade according to claim 3, wherein the left wing and right wing are selectively rotatable about a vertical axis; and wherein the first side of the first member is inclined at an angle relative to the vertical axis.

5. The blade according to claim 2, wherein the left wing and the right wing extend outwardly from a vertical axis; and wherein the snow shield is inclined rearwardly from a first side of the first member and inwardly toward the vertical axis.

6. The blade according to claim 2, further comprising a spring assembly that urges the snow shield into the first position.

7. The blade according to claim 1, wherein the blade is a multi-position blade that further comprises a central hinge with which the left wing and right wing are operationally engaged and about which the left wing and the right wing are selectively pivotable into a number of different configurations.

8. The blade according to claim 1, wherein the biasing assembly is a spring assembly.

9. The blade according to claim 1, wherein the trip edge of each of the left wing and the right wing includes a cutting edge that is adapted to contact the surface from which snow is to be removed by the blade when the trip edge is in a non-tripped position.

10. The blade according to claim 2, wherein a bottom end of the snow shield of the trip edge of each of the left wing and the right wing is adapted to contact the surface from which snow is to be removed when the trip edge is in a non-tripped position.

11. The blade according to claim 1, further comprising a skid shoe operatively engaged with the trip edge, and wherein the skid shoe pivots in unison with the trip edge.

12. A method of preventing damage to a blade of a snowplow comprising:

operatively engaging a left wing and a right wing of the blade of the snowplow with a central shaft;

providing a trip edge on a moldboard of each of the left wing and the right wing;

biasing the trip edge into alignment with the moldboard;

biasing a snow shield provided on the trip edge toward the central shaft;

pivoting the trip edge relative to the moldboard about a horizontal axis when the trip edge impacts an obstacle on a surface from which the blade is clearing snow and trips; and pivoting the snow shield relative to a rest of the trip edge.

13. The method according to claim 12, wherein the pivoting of the trip edge about the horizontal axis includes breaking contact between the trip edge and the surface from which the blade is clearing snow.

14. The method according to claim 12, wherein the pivoting of the snow shield includes pivoting the snow shield about a pivot axis that extends parallel to a first side of a first member of the trip edge.

15. The method according to claim 12, wherein the pivoting of the snow shield includes pivoting the snow shield on the left wing in a first direction and pivoting the snow shield on the right wing in an opposite second direction; and increasing a gap defined between the snow shield on the left wing and the snow shield on the right wing.

16. The method according to claim 12, further comprising pivoting the trip edge in an opposite direction after the trip edge has tripped; and wherein pivoting the trip edge in the opposite direction includes pivoting the trip edge back into alignment with the moldboard under spring force.

17. The method according to claim 12, wherein the pivoting of the snow shield includes pivoting the snow shield away from the central shaft when the trip edge trips and is pivoted out of alignment with the moldboard; and wherein the method further includes pivoting the snow shield back toward the central shaft when the trip edge moves back into alignment with the moldboard.

18. A snowplow comprising:

a vehicle;

a multi-position snowplow blade; and a hitch assembly that selectively secures the multi-position snowplow blade to the vehicle; and wherein the multi-position snowplow blade comprises:

a left wing and a right wing each including:

a moldboard;

a trip edge that is selectively pivotable about a horizontal axis when tripped; and a biasing assembly that biases the trip edge into alignment with the moldboard;

wherein the trip edge includes a snow shield that is pivotally engaged with a rest of the trip edge via a pivot axis;

wherein the snow shield is pivotable about the pivot axis and relative to the rest of the trip edge when the trip edge pivots about the horizontal axis; and a biasing member which biases the snow shield of each of the left wing and the right wing of the snowplow blade towards a central shaft with which each of the left wing and right wing is engaged.

19. The snowplow according to claim 18, wherein the hitch assembly is operable to reconfigure the multi-position snowplow blade and to maneuver the multi-position snowplow blade relative to the utility vehicle.

* * * * *